US011804317B2

(12) United States Patent
Mori et al.

(10) Patent No.: US 11,804,317 B2
(45) Date of Patent: Oct. 31, 2023

(54) SOFT MAGNETIC METAL POWDER AND ELECTRONIC COMPONENT

(71) Applicant: TDK Corporation, Tokyo (JP)

(72) Inventors: Satoko Mori, Tokyo (JP); Kazuhiro Yoshidome, Tokyo (JP); Hiroyuki Matsumoto, Tokyo (JP)

(73) Assignee: TDK Corporation, Tokyo (JP)

( * ) Notice: Subject to any disclaimer, the term of this patent is extended or adjusted under 35 U.S.C. 154(b) by 294 days.

(21) Appl. No.: 16/939,378

(22) Filed: Jul. 27, 2020

(65) Prior Publication Data

US 2021/0035719 A1 Feb. 4, 2021

(30) Foreign Application Priority Data

Jul. 31, 2019 (JP) ..... 2019-141149
May 15, 2020 (JP) ..... 2020-086011

(51) Int. Cl.
*H01F 1/153* (2006.01)

(52) U.S. Cl.
CPC ..... *H01F 1/153* (2013.01)

(58) Field of Classification Search
None
See application file for complete search history.

(56) References Cited

U.S. PATENT DOCUMENTS 5,935,347 A 8/1999 Suzuki et al.
6,562,458 B2 * 5/2003 Elgelid ..... B22F 1/16 428/407
2009/0174512 A1 * 7/2009 Watanabe ..... C22C 33/0207 428/404
2013/0228716 A1 * 9/2013 Su ..... H01F 1/01 427/127
2014/0049348 A1 * 2/2014 Matsuura ..... H01F 27/24 428/307.3
2016/0086717 A1 * 3/2016 Harada ..... C22F 1/10 148/303
2016/0151836 A1 * 6/2016 Matsutani ..... C22C 38/02 252/62.55
2017/0032880 A1 * 2/2017 Jeong ..... H01F 27/292
2018/0068771 A1 * 3/2018 Nakazawa ..... B29C 43/003

FOREIGN PATENT DOCUMENTS

JP 3342767 B2 11/2002
JP 2017-034228 A 2/2017

* cited by examiner

*Primary Examiner* — Kevin E Yoon
*Assistant Examiner* — Ryan L Heckman
(74) *Attorney, Agent, or Firm* — Faegre Drinker Biddle & Reath LLP

(57) ABSTRACT

Provided is a soft magnetic metal powder including a plurality of soft magnetic metal particles. Each of the soft magnetic metal particles includes a metal particle and an oxidized part covering the metal particle. The metal particle includes at least Fe. The oxidized part includes an oxide of at least one kind of element selected from the group consisting of Fe, Si, and B, and at least one kind of element of Ca and Mg. A concentration of Ca or Mg in the metal particle and the oxidized part is maximum in the oxidized part. An average value of a maximum value of the concentration of Ca or Mg in the oxidized part is 0.2 atom % or more.

10 Claims, 5 Drawing Sheets

SOFT MAGNETIC METAL POWDER AND ELECTRONIC COMPONENT

TECHNICAL FIELD

The present invention relates to a soft magnetic metal powder and an electronic component containing the soft magnetic metal powder.

BACKGROUND

Electronic components such as inductors, transformers, and choke coils are widely used in power supply circuits of various electronic devices. The electronic components include a coil and a magnetic core disposed on an inner side of the coil. Recently, as a material of the magnetic core, a soft magnetic metal powder is widely used instead of ferrite in the conventional art. The reason for this is because the soft magnetic metal powder having higher saturation magnetization (saturation magnetic flux density) than ferrite is excellent in DC superimposition characteristics (DC superimposition permitting current is large), and is suitable for reduction in size of the electronic component (magnetic core) (refer to Japanese Patent No. 3342767).

However, in a case where the soft magnetic metal powder is used in the magnetic core, an eddy current is likely to occur in a magnetic core due to electrical conduction between a plurality of soft magnetic metal particles included in the soft magnetic metal powder. That is, in a case where the soft magnetic metal powder is used in the magnetic core, a core loss (eddy current loss) is likely to occur. Due to the core loss, efficiency of the power supply circuit decreases, and power consumption of an electronic device increases. Therefore, it is necessary to reduce the core loss. An electrical insulation property between the soft magnetic metal particles is required to reduce the core loss (refer to Japanese Unexamined Patent Publication No. 2017-34228). In other words, the soft magnetic metal powder is required to have a high withstand voltage so as to reduce the core loss.

SUMMARY

An object of the invention is to provide a soft magnetic metal powder having a high withstand voltage, and an electronic component containing the soft magnetic metal powder.

According to an aspect of the invention, there is provided a soft magnetic metal powder including a plurality of soft magnetic metal particles. Each of the soft magnetic metal particles includes a metal particle and an oxidized part covering the metal particle. The metal particle includes at least Fe. The oxidized part includes an oxide of at least one kind of element selected from the group consisting of Fe, Si, and B, and at least one kind of element of Ca and Mg. A concentration of Ca or Mg in the metal particle and the oxidized part is maximum in the oxidized part. An average value of a maximum value of the concentration of Ca or Mg in the oxidized part is 0.2 atom % or more.

The average value of the maximum value of the concentration of Ca in the oxidized part may be 10.0 atom % or less, and the average value of the maximum value of the concentration of Mg in the oxidized part may be 2.0 atom % or less.

The concentration of Ca or Mg in the oxidized part may be maximum in an outermost surface region of the oxidized part.

At least a part of the metal particle may be an amorphous phase.

At least a part of the metal particle may be a nanocrystal phase.

The soft magnetic metal particle may further include a coating part covering the oxidized part.

At least one kind of element of Ca and Mg may exist in an interface between the oxidized part and the coating part.

The coating part may include glass.

According to another aspect of the invention, there is provided an electronic component containing the soft magnetic metal powder.

According to the invention, there are provided a soft magnetic metal powder having a high withstand voltage, and an electronic component containing the soft magnetic metal powder.

DETAILED DESCRIPTION

Figure 1:
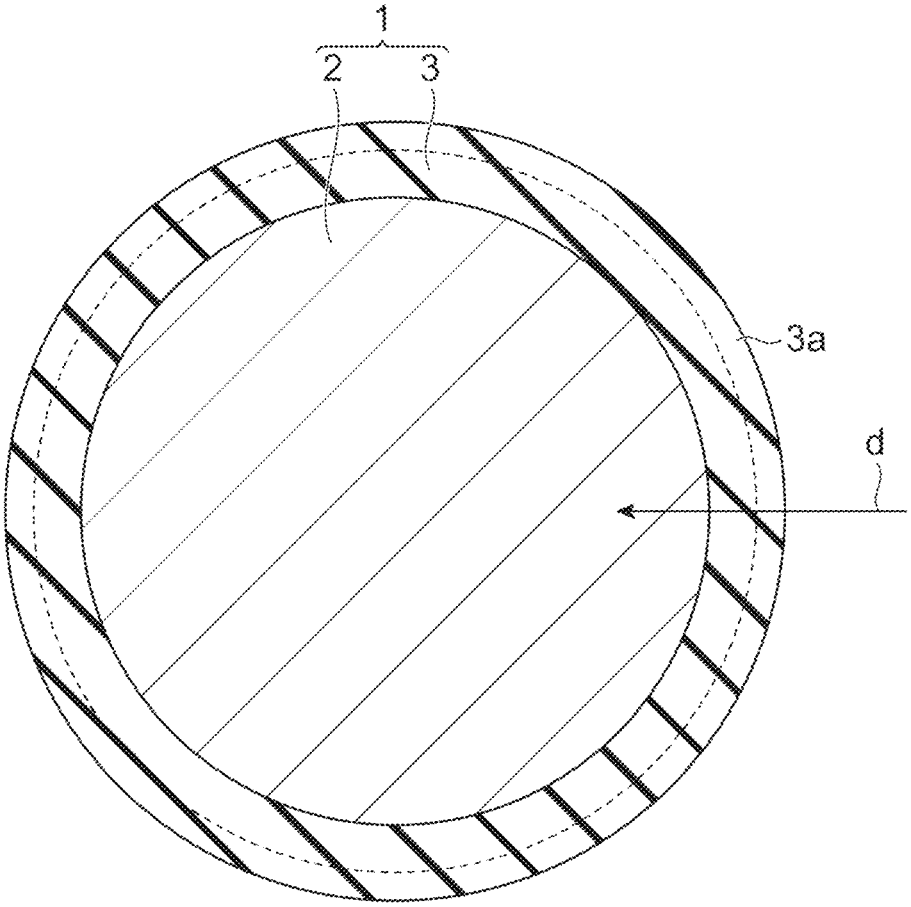
FIG. 1 is a schematic view of a cross-section of a soft magnetic metal particle according to an embodiment of the invention.

Hereinafter, preferred embodiments of the invention will be described with reference to the accompanying drawings. In the drawing, the same reference numeral will be given to an equivalent constituent element. The invention is not limited to the following embodiments.

(Soft Magnetic Metal Powder)

A soft magnetic metal powder according to this embodiment includes a plurality of soft magnetic metal particles. The soft magnetic metal powder may be referred to as the whole of the plurality of soft magnetic metal particles. As illustrated in FIG. 1, a soft magnetic metal particle 1 includes a metal particle 2 and an oxidized part 3 covering the metal particle 2. The soft magnetic metal particle 1 may consist of only the metal particle 2 and the oxidized part 3. The oxidized part 3 may be referred to as an oxidized layer. The oxidized part 3 may be a natural oxide film. Electrical resistance (electrical resistivity) of the oxidized part 3 itself is higher than electrical resistance (electrical resistivity) of the metal particle 2 itself. In other words, the oxidized part 3 has an electrical insulation property. The plurality of soft magnetic metal particles 1 come into contact with each other through the oxidized part 3 having an electrical insulation property, and thus electrical conduction of the soft magnetic metal particles 1 is suppressed. As a result, a withstand voltage of the soft magnetic metal powder increases. That is, the soft magnetic metal powder has a withstand voltage caused by the electrical insulation property of the oxidized part 3. The oxidized part 3 may cover a part or the entirety of the metal particle 2. It is preferable that the oxidized part 3 covers the entirety of the metal particle 2 from the viewpoint that the withstand voltage of the soft magnetic metal powder is likely to increase. The oxidized part 3 may be discontinuous in places. It is preferable that all of the soft magnetic metal particles 1 included in the soft magnetic metal powder include the metal particle 2 and the oxidized part 3 from the viewpoint that the withstand voltage of the soft magnetic metal powder is likely to increase. However, the soft magnetic metal powder may include a small number of metal particles that do not include the oxidized part 3 as long as the withstand voltage of the soft magnetic metal powder is not impaired. Details of a composition of the oxidized part 3 will be described later.

Figure 2:
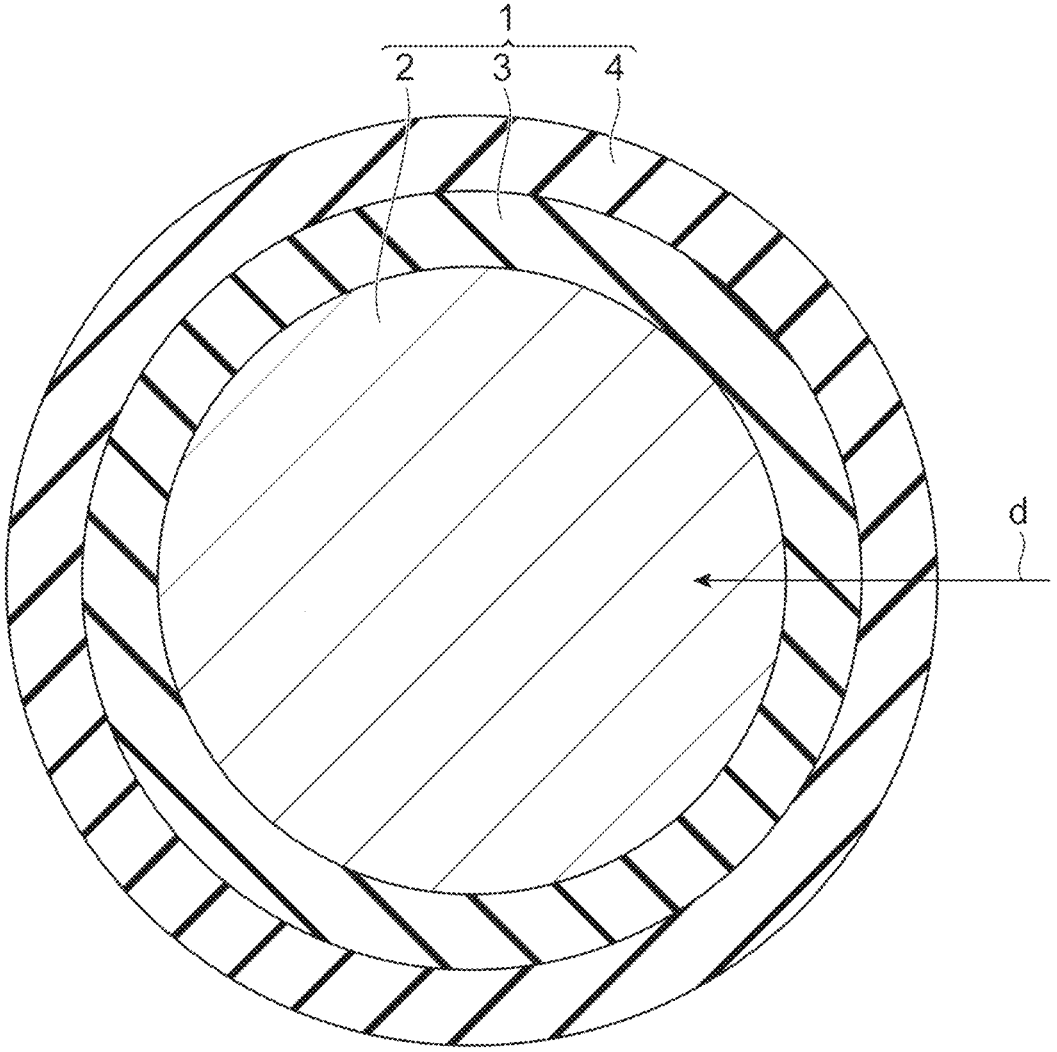
FIG. 2 is a schematic view of a cross-section of a soft magnetic metal particle according to another embodiment of the invention.

As illustrated in FIG. 2, the soft magnetic metal particle 1 may further include a coating part 4 covering the oxidized part 3 in addition to the metal particle 2 and the oxidized part 3. Electrical resistance (electrical resistivity) of the coating part 4 itself is higher than electrical resistance (electrical resistivity) of the metal particle 2 itself. In other words, the coating part 4 has an electrical insulation property. The plurality of soft magnetic metal particles 1 come into contact with each other through the coating part 4 having an electrical insulation property, and thus electrical conduction of the soft magnetic metal particles 1 is further suppressed. As a result, the withstand voltage of the soft magnetic metal powder further increases. The coating part 4 may cover a part or the entirety of the oxidized part 3. It is preferable that the coating part 4 covers the entirety of the oxidized part 3 from the viewpoint that the withstand voltage of the soft magnetic metal powder is likely to increase. In a case where a part of the metal particle 2 is exposed without being covered with the oxidized part 3, the coating part 4 may directly cover the part of the metal particle 2. The coating part 4 may include a plurality of coating layers having compositions different from each other, or a plurality of coating layers may be stacked in a direction orthogonal to an outermost surface of the oxidized part 3. The outermost surface of the oxidized part 3 is a surface that is not contact with the metal particle 2 in the surface of the oxidized part 3. The coating part 4 may be one layer having a uniform composition.

The coating part 4 may include glass. The coating part 4 may consist of only the glass. When the coating part 4 includes the glass, the electrical insulation property of the coating part 4 is likely to be improved, and as a result, the withstand voltage of the soft magnetic metal powder is likely to increase. In addition, when the coating part 4 includes the glass, friction and aggregation between the soft magnetic metal particles 1 are likely to be suppressed, a volume density and a filling rate of the soft magnetic metal powder are likely to increase, and relative magnetic permeability of the entirety of the soft magnetic metal powder is likely to increase. However, the composition of the coating part 4 is not limited to the glass. Details of the composition of the coating part 4 will be described later.

The following "coated particle" represents the soft magnetic metal particle 1 including the coating part 4. The following "uncoated particle" represents the soft magnetic metal particle 1 that does not include the coating part 4.

The soft magnetic metal powder may include both the coated particle and the uncoated particle. The higher a ratio of the number of coated particles occupied in the soft magnetic metal powder is, the higher the withstand voltage of the soft magnetic metal powder is. The ratio of the number of the coated particles occupied in the soft magnetic metal powder may be from 90% to 100%, or may be from 95% to 100%. The soft magnetic metal powder may consist of only the coated particles from the viewpoint that the withstand voltage of the soft magnetic metal powder is likely to increase. However, the soft magnetic metal powder may consist of only uncoated particles.

The metal particle 2 includes at least iron (Fe). The metal particle 2 may consist of only Fe. The metal particle 2 may include an alloy including Fe. The metal particle 2 may consist of only an alloy including Fe. Soft magnetic properties of the soft magnetic metal powder result from a composition of the metal particle 2. For example, the soft magnetic properties represent high relative magnetic permeability, high saturation magnetization, and a low coercivity. Details of the composition of the metal particle 2 will be described later.

The oxidized part 3 includes an oxide of at least one kind of element selected from the group consisting of Fe, silicon (Si), and boron (B). The oxide may be a main component of the oxidized part 3. The oxidized part 3 further includes at least one kind of element of calcium (Ca) and magnesium (Mg). For example, the oxidized part 3 may include an oxide of at least one kind of element of Ca and Mg. When the oxidized part 3 has the above-described composition, the oxidized part 3 can have an excellent electrical insulation property. As a result, the soft magnetic metal powder can have a high withstand voltage. The oxidized part 3 may include only Fe among Fe, Si, and B. The oxidized part 3 may include only Si among Fe, Si, and B. The oxidized part 3 may include only B among Fe, Si, and B. The oxidized part 3 may include only Fe and Si among Fe, Si, and B. The oxidized part 3 may include only Si and B among Fe, Si, and B. The oxidized part 3 may include only B and Fe among Fe, Si, and B. The oxidized part 3 may include all of Fe, Si, and B. The oxidized part 3 may include only Ca of Ca and Mg. The oxidized part 3 may include only Mg of Ca and Mg. The oxidized part 3 may include both Ca and Mg. The oxide included in the oxidized part 3 may be a composite oxide including two or more kinds of elements selected from the group consisting of Fe, Si, B, Ca, and Mg. The oxidized part 3 may further include another element other than Fe, Si, B, Ca, and Mg. For example, the oxidized part 3 may further include a Group 1 element (or alkali metal) such as lithium (Li), sodium (Na), and potassium (K). The oxidized part 3 may further include a Group 2 element (or alkali-earth metal) such as beryllium (Be), strontium (Sr), and barium (Ba).

A concentration of Ca or Mg in the metal particle 2 and the oxidized part 3 is maximum in the oxidized part 3. That is, a concentration distribution of Ca or Mg in the metal particle 2 and the oxidized part 3 is not constant, and has a maximum value in the oxidized part 3. A unit of the concentration of Ca and Mg in the metal particle 2 and the oxidized part 3 is atom %. Only the oxidized part 3 between the metal particle 2 and the oxidized part 3 may include at least one element of Ca and Mg. Both the metal particle 2 and the oxidized part 3 may include at least one element of Ca and Mg. The concentration of Ca in the metal particle 2 and the oxidized part 3 may be maximum in the oxidized part 3, and the concentration of Mg in the metal particle 2 and the oxidized part 3 may also be maximum in the oxidized part 3. A maximum value of the concentration of Ca in the oxidized part 3 may be an absolute maximum value of the concentration of Ca in the oxidized part 3 and the metal particle 2. A maximum value of the concentration of Mg in the oxidized part 3 may be an absolute maximum value of the concentration of Mg in the oxidized part 3 and the metal particle 2. An average value of the maximum value of the concentration of Ca or Mg in the oxidized part 3 is 0.2 atom % or more. The following [Ca] represents an average value of the maximum value of the concentration of Ca in the oxidized part 3. The following [Mg] represents an average value of the maximum value of the concentration of Mg in the oxidized part 3. From the viewpoint that the withstand voltage of the soft magnetic metal powder is likely to increase, it is preferable that the concentration of Ca or Mg is maximum in the oxidized part 3 of all of a plurality of the soft magnetic metal particles 1 included in the soft magnetic metal powder. However, the soft magnetic metal powder may include few metal particles in which the concentration of Ca or Mg is maximum in a portion other than the oxidized part 3 may be included in the soft magnetic metal powder as long as the withstand voltage of the soft magnetic metal powder is not deteriorated.

Only one of [Ca] and [Mg] may be 0.2 atom % or more, and both [Ca] and [Mg] may be 0.2 atom % or more. When [Ca] or [Mg] is 0.2 atom % or more, the soft magnetic metal powder can have a high withstand voltage. That is, a withstand voltage of a soft magnetic metal powder in which [Ca] or [Mg] is 0.2 atom % or more is significantly higher than a withstand voltage of a soft magnetic metal powder in which any of [Ca] and [Mg] is less than 0.2 atom %.

The following "V1" represents a withstand voltage of a soft magnetic metal powder consisting of only the uncoated particles. The following "V2" represents a withstand voltage of a soft magnetic metal powder including the coated particles. A unit of V1 and V2 is V/mm. The following "ΔV" represents V2−V1.

In a case where [Ca] or [Mg] is 0.2 atom % or more, V2 is high. That is, in a case where [Ca] or [Mg] is 0.2 atom % or more, the soft magnetic metal powder including the coated particles can have a high withstand voltage. In addition, in a case where [Ca] or [Mg] is 0.2 atom % or more, ΔV is high. That is, in a case where [Ca] or [Mg] is 0.2 atom % or more, an increase amount of the withstand voltage of the soft magnetic metal particle 1 according to formation of the coating part 4 is large. The present inventors assume that in a case where [Ca] or [Mg] is 0.2 atom % or more, the coating part 4 is likely to be in close contact with an outermost surface of the oxidized part 3, and V2 and ΔV significantly increase in accordance with close contact of the coating part 4.

In addition, in a case where [Ca] is more than 10.0 atom %, V1 decreases. Even in a case where [Mg] is more than 2.0 atom %, V1 decreases. It is considered that in a case where [Ca] or [Mg] is excessively large, a shape of the oxidized part 3 including at least one kind of element of Ca and Mg becomes non-uniform, and it is difficult for the oxidized part 3 to uniformly cover the metal particle 2, and thus V1 decreases.

In addition, in a case where [Ca] is more than 10.0 atom %, V2 and ΔV decrease. Even in a case where [Mg] is more than 2.0 atom %, V2 and ΔV decrease. It is considered that in a case where [Ca] or [Mg] is excessively large, a shape of the oxidized part 3 including at least one kind of element of Ca and Mg becomes non-uniform, and it is difficult for the coating part 4 to uniformly cover the metal particle 2 and the oxidized part 3, and thus V2 and ΔV decrease.

[Ca] and [Mg] may be measured by ray analysis to be described below.

Twenty soft magnetic metal particles 1 are randomly selected from the soft magnetic metal powder. A concentration distribution of each of Ca and Mg in the metal particle 2 and the oxidized part 3 of each of the soft magnetic metal particles 1 is measured. A maximum value of the concentration of each of Ca and Mg is specified on the basis of the concentration distribution that is measured. The concentration distribution of each of Ca and Mg is measured at a cross-section of the soft magnetic metal particle 1 in a direction orthogonal to an outermost surface of the oxidized part 3. That is, the concentration distribution of each of Ca and Mg is measured along a direction orthogonal to the outermost surface of the oxidized part 3. The direction orthogonal to the outermost surface of the oxidized part 3 is a depth direction d illustrated in FIG. 1. Accordingly, the concentration distribution of each of Ca and Mg may be referred to as a concentration distribution of each of Ca and Mg along a line segment extending in the depth direction d. The line segment extending in the depth direction d may be a line segment that connects the center of the metal particle 2 and the outermost surface of the oxidized part 3. The line segment extending in the depth direction d may be a line segment that crosses the entirety of the metal particle 2 and the oxidized part 3. Measurement means of the concentration distribution of each of Ca and Mg may be energy dispersive X-ray spectroscopy (EDS). For example, a cross-section analyzed by the EDS may be observed by a scanning transmission electron microscope (STEM).

The average value of the maximum value of the concentration of Ca is calculated from the maximum value of the concentration of Ca which is measured in the twenty soft magnetic metal particles 1 by the above-described method. The average value of the maximum value of the concentration of Mg is calculated from the maximum value of the concentration of Mg which is measured in the twenty soft magnetic metal particles 1 by the above-described method. A concentration distribution of other elements included in the soft magnetic metal particles 1 may be measured by the same method as in the concentration distribution of each of Ca and Mg.

[Ca] may be from 0.2 atom % to 10.0 atom %, from 0.2 atom % to 9.0 atom %, from 0.2 atom % to 8.0 atom %, from 0.2 atom % to 7.0 atom %, from 0.2 atom % to 6.0 atom %, from 0.2 atom % to 5.0 atom %, from 0.2 atom % to 4.0 atom %, from 0.2 atom % to 3.0 atom %, from 0.2 atom % to 2.0 atom %, or from 0.2 atom % to 1.0 atom %. [Mg] may be from 0.2 atom % to 2.0 atom %, from 0.2 atom % to 1.0 atom %, or from 0.2 atom % to 0.8 atom %. In a case where [Ca] or [Mg] is within any one of the ranges, the soft magnetic metal powder is likely to have both excellent soft magnetic characteristics and a high withstand voltage.

The concentration of Ca or Mg in the oxidized part 3 of each of the soft magnetic metal particles 1 may be maximum in an outermost surface region 3*a* of the oxidized part 3. When the concentration of Ca or Mg is maximum in the outermost surface region 3*a* of the oxidized part 3, the coating part 4 is likely to be in close contact with the outermost surface of the oxidized part 3, and V2 and ΔV are likely to increase. From the same reason, at least one kind of element of Ca and Mg may exist in an interface between the oxidized part 3 and the coating part 4. Even in a case where the coating part 4 does not exist, when the concentration of Ca or Mg in the outermost surface region 3*a* of the oxidized part 3 is maximum, the soft magnetic metal powder (uncoated particles) is likely to have high V1. The outermost surface region 3*a* of the oxidized part 3 may be a region within a distance of 5 nm from the outermost surface of the oxidized part 3 in the oxidized part 3. The outermost surface region 3*a* of the oxidized part 3 may be a region within a distance of 2 nm from the outermost surface of the oxidized part 3 in the oxidized part 3.

At least a part of the metal particle 2 may be an amorphous phase. The metal particle 2 may consist of only the amorphous phase. That is, the entirety of the metal particle 2 may be the amorphous phase. The soft magnetic metal particle 1 including the amorphous phase has more excellent soft magnetic characteristics than a soft magnetic metal particle constituted by a coarse crystal phase in the conventional art. For example, the soft magnetic metal particle 1 including an amorphous phase can have higher saturation magnetization and a lower coercivity than the soft magnetic metal particle in the conventional art. Examples of the coarse crystal phase included in the soft magnetic metal particle in the conventional art include a crystal having a grain size or a crystallite size more than 30 nm. As a volume ratio of the amorphous phase occupied in the metal particle 2 increases, crystalline magnetic anisotropy of the soft magnetic metal particle 1 is reduced, and thus a magnetic loss (hysteresis loss) of a magnetic core formed from the soft magnetic metal particle 1 is reduced.

At least a part of the metal particle 2 may be a crystalline phase. The entirety of the metal particle 2 may be the crystalline phase. The metal particle 2 may include both the crystalline phase and the amorphous phase. At least a part of the metal particle 2 may be a nanocrystal phase. The nanocrystal may be a crystal of Fe simple substance or a crystal of an alloy including Fe. The entirety of the metal particle 2 may be the nanocrystal phase. The soft magnetic metal particle 1 including the nanocrystal phase has more excellent soft magnetic characteristics than a soft magnetic metal particle that does not include the nanocrystal phase and includes the amorphous phase. For example, the soft magnetic metal particle 1 including the nanocrystal phase can have higher saturation magnetization and a lower coercivity than a soft magnetic metal particle that does not include the nanocrystal phase and includes the amorphous phase. The metal particle 2 may include a plurality of nanocrystal phases. The metal particle 2 may consist of only the plurality of nanocrystal phase. The metal particle 2 may consist of only one nanocrystal phase. A crystal structure of the nanocrystal phase may be, for example, a body-centered cubic lattice structure. For example, a grain size (average crystallite size) of the nanocrystal phase may be from 5 nm to 30 nm.

From the viewpoint that the soft magnetic metal powder is likely to have excellent soft magnetic characteristics, it is preferable that the metal particle 2 includes at least one of the amorphous phase and the nanocrystal phase. From the same reason, the metal particle 2 may include both the amorphous phase and the nanocrystal phase. For example, the metal particle 2 may have a nanohetero structure consisting of the amorphous phase and a plurality of the nanocrystal phases dispersed in the amorphous phase. In a case where the metal particle 2 has the nanohetero structure, saturation magnetization of a soft magnetic metal powder is likely to increase, and a coercivity of the soft magnetic metal powder is likely to decrease. For example, a grain size (average crystallite size) of the nanocrystal phases included in the nanohetero structure may be from 5 nm to 30 nm, or from 0.3 nm to 10 nm.

The metal particle 2 may not include the amorphous phase and the nanocrystal phase. For example, a part or the entirety of the metal particle 2 may be one or more coarse crystal phases.

The metal particle 2 may be an alloy including at least one kind of element selected from the group consisting of niobium (Nb), hafnium (Hf), zirconium (Zr), tantalum (Ta), molybdenum (Mo), tungsten (W), vanadium (V), boron (B), phosphorus (P), silicon (Si), carbon (C), sulfur (S), titanium (Ti), cobalt (Co), nickel (Ni), aluminum (Al), manganese (Mn), silver (Ag), zinc (Zn), tin (Sn), arsenic (As), antimony (Sb), copper (Cu), chromium (Cr), bismuth (Bi), nitrogen (N), oxygen (O), and rare earth elements in addition to Fe.

The metal particle 2 may include an alloy expressed by the following Chemical Formula 1. The metal particle 2 may consist of only the alloy expressed by the following Chemical Formula 1.

$$(Fe_{(1-(\alpha+\beta))}X1_{\alpha}X2_{\beta})_{(1-h)}M_aB_bP_cSi_dC_eS_f \quad (1)$$

B in Chemical Formula 1 described above is boron. P in Chemical Formula 1 described above is phosphorus. Si in Chemical Formula 1 described above is silicon. C in Chemical Formula 1 described above is carbon. S in Chemical Formula 1 described above is sulfur. h in Chemical Formula 1 described above is equal to a+b+c+d+e+f. his more than 0 and less than 1.

M in Chemical Formula 1 described above is at least one kind of element selected from the group consisting of Nb, Hf, Zr, Ta, Mo, W, Ti, and V.

X1 in Chemical Formula 1 described above is at least one kind of element selected from the group consisting of Co and Ni.

X2 in Chemical Formula 1 described above is at least one kind of element selected from the group consisting of Al, Mn, Ag, Zn, Sn, As, Sb, Cu, Cr, Bi, N, O, and a rare earth element. The rare earth element is at least one kind of element selected from the group consisting of scandium (Sc), yttrium (Y), lanthanum (La), cerium (Ce), praseodymium (Pr), neodymium (Nd), promethium (Pm), samarium (Sm), europium (Eu), gadolinium (Gd), terbium (Tb), dysprosium (Dy), holmium (Ho), erbium (Er), thulium (Tm), ytterbium (Yb), and lutetium (Lu).

a in Chemical Formula 1 described above may satisfy the following inequalities.

$0.020 \le a \le 0.140$, $0.040 \le a \le 0.100$, or $0.050 \le a \le 0.080$.

In a case where a is excessively small, in a process of producing a soft magnetic metal powder, a coarse crystal having a grain size more than 30 nm is likely to precipitate in the metal particle 2, and a fine nanocrystal phase is less likely to precipitate in the metal particle 2. As a result, a coercivity of the soft magnetic metal powder is likely to increase. In a case where a is excessively large, saturation magnetization of the soft magnetic metal powder is likely to decrease.

b in Chemical Formula 1 described above may satisfy the following inequalities.

$0 \le b \le 0.20$, $0 < b \le 0.20$, $0.020 \le b \le 0.20$, $0.020 < b \le 0.20$, $0.025 \le b \le 0.20$, $0.060 \le b \le 0.15$, or $0.080 \le b \le 0.12$.

In a case where b is excessively small, in a process of producing the soft magnetic metal powder, a coarse crystal having a grain size more than 30 nm is likely to precipitate in the metal particle 2, and a fine nanocrystal phase is less likely to precipitate in the metal particle 2. As a result, the coercivity of the soft magnetic metal powder is likely to increase. In a case where b is excessively large, the saturation magnetization of the soft magnetic metal powder is likely to decrease.

c in Chemical Formula 1 described above may satisfy the following inequalities.

$0 \leq c \leq 0.15$, $0 < c \leq 0.15$, $0.005 \leq c \leq 0.100$, or $0.010 \leq c \leq 0.100$.

In a case where c satisfies $0.005 \leq c \leq 0.100$, electrical resistivity of the soft magnetic metal powder is likely to increase, and the coercivity is likely to decrease. In a case where c is excessively small, the coercivity is likely to increase. In a case where c is excessively large, the saturation magnetization of the soft magnetic metal powder is likely to decrease.

d in Chemical Formula 1 described above may satisfy the following inequalities.

$0 \leq d \leq 0.175$, $0 \leq d \leq 0.155$, $0 \leq d \leq 0.150$, $0 \leq d \leq 0.135$, $0 \leq d \leq 0.100$, $0 \leq d \leq 0.090$, $0 \leq d \leq 0.060$, $0.001 \leq d \leq 0.040$, or $0.005 \leq d \leq 0.040$.

In a case where d is within the above-described ranges, the coercivity of the soft magnetic metal powder is likely to decrease. In a case where d is excessively large, the coercivity of the soft magnetic metal powder is likely to increase.

e in Chemical Formula 1 described above may satisfy the following inequalities.

$0 \leq e \leq 0.150$, $0 \leq e \leq 0.080$, $0 \leq e \leq 0.040$, $0 \leq e \leq 0.035$, $0 \leq e \leq 0.030$, or $0.001 \leq e \leq 0.030$.

In a case where e is within the above-described ranges, the coercivity of the soft magnetic metal powder is likely to decrease. In a case where e is excessively large, the coercivity of the soft magnetic metal powder is likely to increase.

f in Chemical Formula 1 described above may satisfy the following inequalities.

$0 \leq f \leq 0.030$, $0 \leq f \leq 0.010$, $0 < f \leq 0.010$, $0.001 \leq f \leq 0.010$, or $0.002 \leq f \leq 0.010$.

In a case where f is within the above-described ranges, the coercivity of the soft magnetic metal powder is likely to decrease. In a case where f is excessively large, the coercivity of the soft magnetic metal powder is likely to increase. In a case where f is more than 0 (in a case where f is 0.001 or more), the sphericity of each soft magnetic metal particle is high, and a density (filling rate) of a magnetic core produced through compression molding of the soft magnetic metal powder is likely to increase, and the relative magnetic permeability of the magnetic core is likely to increase.

1-h in Chemical Formula 1 described above may satisfy the following inequalities.

$0.6844 \leq 1-h \leq 0.9050$ or $0.73 \leq 1-h \leq 0.95$.

In a case where 1−h satisfies $0.73 \leq 1-h \leq 0.95$, in a process of producing the soft magnetic metal powder, a coarse crystal having a grain size more than 30 nm is less likely to precipitate in the metal particle 2.

α and h in Chemical Formula 1 described above may satisfy the following inequalities.

$0 \leq \alpha(1-h) \leq 0.40$ or $0.01 \leq \alpha(1-h) \leq 0.40$.

β and h in Chemical Formula 1 described above may satisfy the following inequalities.

$0 \leq \beta(1-h) \leq 0.050$, $0.001 \leq \beta(1-h) \leq 0.050$, $0 \leq \beta(1-h) \leq 0.030$, or $0.001 \leq \beta(1-h) \leq 0.030$.

α+β in Chemical Formula 1 described above may satisfy $0 \leq \alpha+\beta \leq 0.50$. In a case where α+β is excessively large, a fine nanocrystal phase is less likely to precipitate in the metal particle 2.

The composition of the coating part 4 is not limited as long as the coating part 4 electrically insulates the soft magnetic metal particles 1 from each other. For example, the coating part 4 may include at least one kind of element selected from the group consisting of phosphorus (P), silicon (Si), bismuth (Bi), zinc (Zn), sodium (Na), magnesium (Mg), calcium (Ca), strontium (Sr), barium (Ba), boron (B), aluminum (Al), indium (In), carbon (C), germanium (Ge), lead (Pb), arsenic (As), antimony (Sb), oxygen (O), sulfur (S), selenium (Se), tellurium (Te), fluorine (F), chlorine (Cl), bromine (Br), titanium (Ti), vanadium (V), chromium (Cr), iron (Fe), cobalt (Co), nickel (Ni), copper (Cu), zirconium (Zr), molybdenum (Mo), and tungsten (W). It is preferable that the coating part 4 includes a compound including at least one element A selected from the group consisting of P, Si, Bi, and Zn. The compound including at least one element A selected from the group consisting of P, Si, Bi, and Zn is noted as "compound A". For example, the compound A may be a compound including P. The compound A may be an oxide (preferably, oxide glass). These compounds A are likely to bond with an element (particularly, P or Si) included in the metal particle 2 and the oxidized part 3. Particularly, the compound A is likely to bond with an element (particularly, P or Si) segregated in an amorphous phase of the metal particle 2. As a result, the coating part 4 is likely to be in close contact with the oxidized part 3, and the withstand voltage of the soft magnetic metal powder is likely to increase.

The compound A may be a main component of the coating part 4. In other words, in a case where the total mass of all elements (excluding oxygen) included in the coating part 4 is 100 parts by mass, a total mass of the element A may be from 50 parts by mass to 100 parts by mass, or from 60 parts by mass to 100 parts by mass. The coating part 4 may consist of only the compound A.

In a case where the coating part 4 includes oxide glass, the oxide glass may be at least one kind of glass selected from the group consisting of phosphate-based glass ($P_2O_5$-based glass), bismuthate-based glass ($Bi_2O_3$-based glass), silicate-based glass ($SiO_2$-based glass), and borosilicate-based glass ($B_2O_3$—$SiO_2$-based glass).

The content of $P_2O_5$ in the $P_2O_5$-based glass may be from 50% by mass to 100% by mass. For example, the $P_2O_5$-based glass may be $P_2O_5$—ZnO—$R_2O$—$Al_2O_3$-based glass. R is an alkali metal.

The content of $Bi_2O_3$ in $Bi_2O_3$-based glass may be from 50% by mass to 100% by mass. For example, the $Bi_2O_3$-based glass may be $Bi_2O_3$—ZnO—$B_2O_3$—$SiO_2$-based glass.

The content of $B_2O_3$ in the $B_2O_3$—$SiO_2$-based glass may be from 10% by mass to 90% by mass, and the content of $SiO_2$ in the $B_2O_3$—$SiO_2$-based glass may be from 10% by mass to 90% by mass. For example, the $B_2O_3$—$SiO_2$-based glass may be BaO—ZnO—$B_2O_3$—$SiO_2$—$Al_2O_3$-based glass.

For example, a median diameter (D50) of the soft magnetic metal powder may be from 0.3 μm to 100 μm. D50 may be specified on the basis of a number-based particle size distribution of the soft magnetic metal powder. The soft magnetic metal powder may be a mixture of two or more kinds of metal powders different in a particle size or a particle size distribution. The particle size and the particle size distribution of the soft magnetic metal powder may be adjusted by sieving classification, airflow classification, or the like. For example, the particle size and the particle size distribution of the soft magnetic metal powder may be measured by a laser diffraction scattering method. From the viewpoint that a volume density and relative magnetic permeability of the soft magnetic metal powder are likely to increase, a shape of each soft magnetic metal particle 1 may be approximately spherical. However, the shape of the soft magnetic metal particle 1 is not limited. For example, the thickness of the oxidized part 3 may be from 1 nm to 20 nm. For example, the thickness of the coating part 4 may be from 5 nm to 200 nm, from 5 nm to 150 nm, or from 5 nm to 50 nm.

A structure, dimensions, and a composition of each of the metal particle 2, the oxidized part 3, and the coating part 4 may be analyzed by a method such as scanning transmission electron microscope (STEM), transmission electron microscope (TEM), energy dispersive X-ray spectroscopy (EDS), electron energy loss spectroscopy (EELS), fast Fourier transform (FFT) analysis of TEM images, and a powder X-ray diffraction (XRD) method.

(Method for Producing Soft Magnetic Metal Powder)

The soft magnetic metal powder according to this embodiment can be produced by a gas atomizing method or water atomizing method. From the viewpoint that at least any one phase of an amorphous phase and a nanocrystal phase is likely to be formed in the metal particle 2 of the soft magnetic metal particle 1, it is preferable that the soft magnetic metal powder is produced by the gas atomizing method. Details of the gas atomizing method and the water atomizing method are as follows.

[Gas Atomizing Method]

In the gas atomizing method, a metal raw material is melted to form a molten metal, a high-pressure gas is sprayed to the molten metal to form liquid droplets, and the liquid droplets are rapidly cooled with cooling water to form a soft magnetic metal powder. As to be described later, after carrying out the gas atomizing method, a heat treatment on the soft magnetic metal powder may be further performed.

Figure 3:
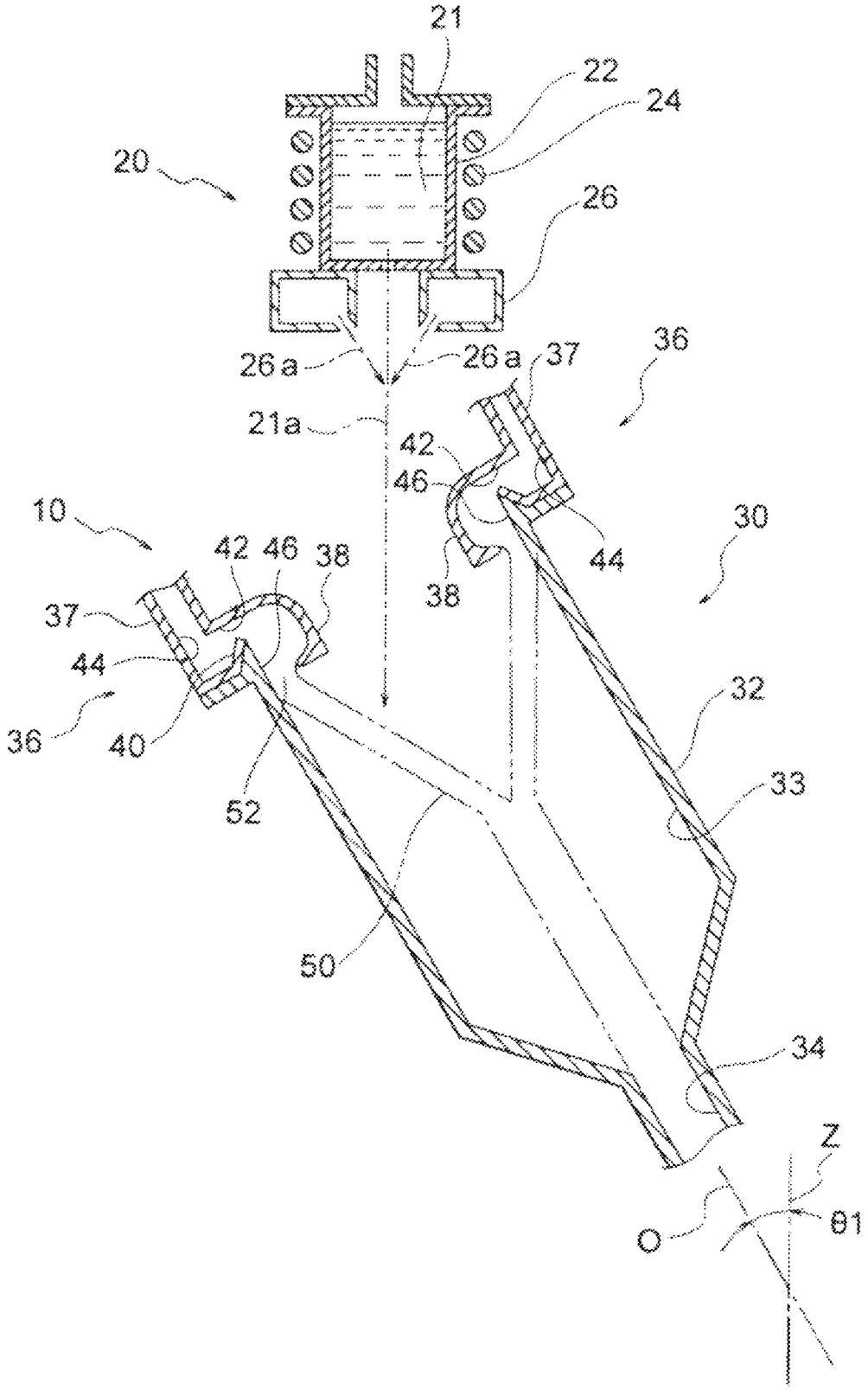
FIG. 3 is a schematic view of a cross-section of a gas atomizing apparatus that is used in production of a soft magnetic metal powder.

The gas atomizing method may be carried out by using a gas atomizing apparatus 10 illustrated in FIG. 3. The gas atomizing apparatus 10 includes a supply unit 20 and a cooling unit 30 disposed on a downward side of the supply unit 20. A Z-axis direction in FIG. 3 is a vertical direction.

The supply unit 20 includes a heat-resistant container 22, and a coil 24 (heating device) disposed at the periphery of the container 22. As a raw material of the soft magnetic metal powder, a metal raw material is contained in the container 22.

The metal raw material may be a simple substance of a metal such as Fe. The metal raw material may be an alloy. A composition of the metal raw material may be a composition expressed by Chemical Formula 1 described above. A mixture of a plurality of kinds of metal raw materials may be used. In the case of using the plurality of kinds of metal raw materials, each of the metal raw materials may be weighed so that a composition of the entirety of the plurality of kinds of metal raw materials matches Chemical Formula 1 described above. The metal raw material may include inevitable impurities. The content of the inevitable impurities in all of the metal raw materials may be from 0% by mass to 0.1% by mass. A form of the metal raw material may be, for example, an ingot, a chunk (lump), or a shot (particle).

The metal raw material in the container 22 is heated by the coil 24. As a result, the metal raw material in the container 22 is melted, and becomes a molten metal 21. A temperature of the molten metal 21 may be adjusted in correspondence with a melting point of metals included in the metal raw material. For example, the temperature of the molten metal 21 may be from 1200° C. to 1500° C.

The molten metal 21 is supplied dropwise from an ejection port of the container 22 toward the cooling unit 30. In addition, a high-pressure gas 26*a* is sprayed from a gas nozzle 26 to the molten metal 21. As a result, a plurality of fine liquid droplets 21*a* are formed from the molten metal 21. The liquid droplets 21*a* move to the inside of a tubular body 32 of the cooling unit 30 in accordance with the high-pressure gas 26*a*. For example, an atmosphere inside the tubular body 32 may be vacuum.

The high-pressure gas sprayed to the molten metal 21 may be, for example, an inert gas or a reducing gas. For example, the inert gas may be at least one kind of gas selected from the group consisting of nitrogen ($N_2$), argon (Ar), and helium (He). For example, the reducing gas may be an ammonia decomposition gas. In a case where the molten metal 21 consists of a metal that is not easily oxidized, the high-pressure gas may be air.

When the cooling water is supplied from an introduction part 36 to the inside of the tubular body 32, a water flow 50 is formed inside the tubular body 32. A shape of the water flow 50 is an inverted cone. When the liquid droplet 21*a* collides with the inverted conical water flow 50, the liquid droplet 21*a* is decomposed into finer liquid droplets. The fine liquid droplets are rapidly cooled by the water flow 50, and are solidified. The water flow 50 (cooling water) includes at least any one of Ca and Mg. Accordingly, a surface of fine liquid droplets comes into contact with the water flow 50, and thus at least one of Ca and Mg adheres to the surface of the liquid droplets. In addition, the surface of the liquid droplets may be oxidized due to contact between the liquid droplets and the water flow 50. Alternatively, after the metal particle 2 to which at least one of Ca and Mg adheres is formed, the surface of the metal particle 2 may be naturally oxidized in the air.

Due to the above-described rapid cooling of the liquid droplets (and the subsequent natural oxidization), a plurality of the soft magnetic metal particles 1 (uncoated particles) including the oxidized part 3 and the metal particle 2 coated with the oxidized part 3 are formed.

As described above, since the inverted conical water flow 50 is formed inside the tubular body 32, movement time of the liquid droplet 21*a* in the air is further shortened in comparison to a case where a water flow is formed along an inner wall of the tubular body 32. That is, time required for the liquid droplet 21*a* to reach the water flow 50 from the container 22 is shortened. Due to shortening of the movement time of the liquid droplet 21*a* in the air, rapid cooling of the liquid droplet 21*a* is promoted, and thus an amorphous phase is likely to be formed in the obtained soft magnetic metal particles. In addition, due to shortening of the movement time of the liquid droplet 21*a* in the air, oxidization of the liquid droplet 21*a* during movement is suppressed. As a result, the liquid droplet 21*a* is likely to be decomposed into fine liquid droplets in the water flow 50, and the quality of the obtained soft magnetic metal powder is improved.

For example, the cooling water may be an aqueous solution calcium carbonate ($CaCO_3$). The cooling water may be an aqueous solution of magnesium carbonate ($MgCO_3$). For example, the cooling water may be an aqueous solution of $CaCO_3$ and $MgCO_3$. The content of $CaCO_3$ in the cooling water may be from 800 mg/liter to 2500 mg/liter, or from 1000 mg/liter to 2000 mg/liter. In a case where the content of $CaCO_3$ in the cooling water is excessively low, the average value of the maximum value of the concentration of Ca in the oxidized part 3 is likely to be less than 0.2 atom %. The content of $MgCO_3$ in the cooling water may be from 160 mg/liter to 500 mg/liter, or from 200 mg/liter to 400 mg/liter. In a case where the content of $MgCO_3$ in the cooling water is excessively low, the average value of the maximum value of the concentration of Mg in the oxidized part 3 is likely to be less than 0.2 atom %.

An angle between a central axial line O of the tubular body 32 and the Z-axis direction is expressed as θ1. For example, θ1 may be from 0° to 45°. When θ1 is from 0° to 45°, the liquid droplet 21*a* easily comes into contact with the inverted conical water flow 50.

A discharge part 34 is provided on a downward side of the tubular body 32. The cooling water including the soft magnetic metal powder is discharged from the discharge part 34 to the outside of the tubular body 32. The cooling water discharged from the discharge part 34 may be contained, for example, in a storage tank. In the storage tank, the soft magnetic metal powder settles to the bottom of the storage tank due to weight of the soft magnetic metal powder. As a result, the soft magnetic metal powder is separated from the cooling water.

In the gas atomizing method, since the liquid droplet 21*a* is rapidly cooled by the cooling water, an amorphous phase is likely to be formed in soft magnetic metal particles 1 (metal particles 2). Amorphousness and a shape of the soft magnetic metal particles 1 may be controlled by a temperature of the cooling water supplied to the cooling unit 30 (tubular body 32), a shape of the water flow 50, a flow rate of the cooling water, or a flow amount of the cooling water.

Figure 4:
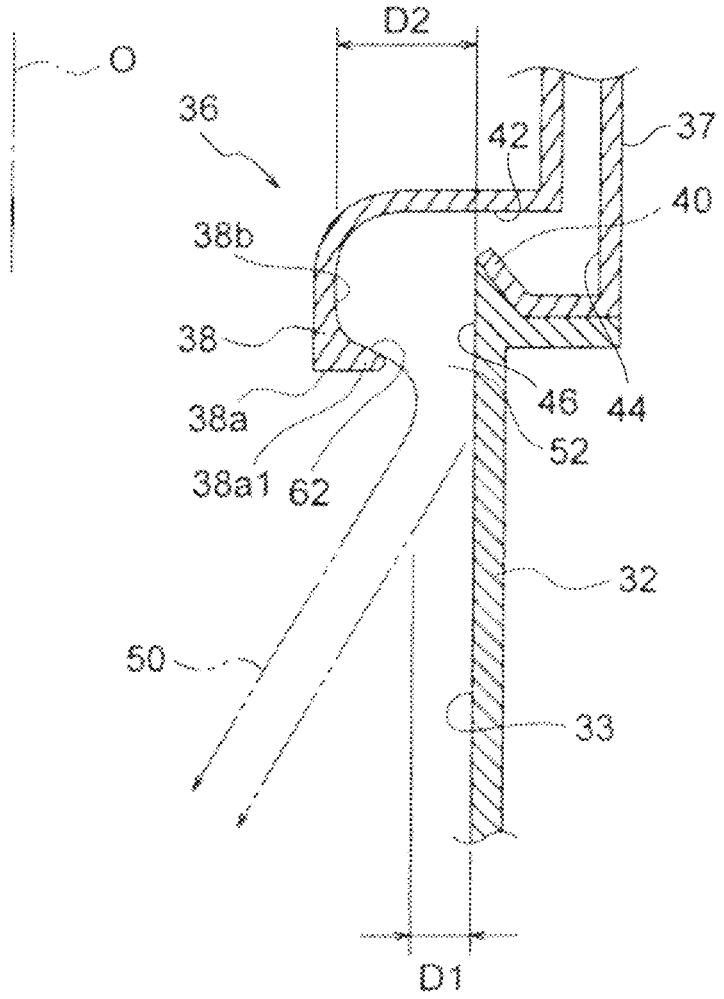
FIG. 4 is a view illustrating an enlarged cross-section of a part (a cooling water introduction part) of the apparatus illustrated in FIG. 3.

FIG. 4 is an enlarged view of the cooling water introduction part 36 illustrated in FIG. 3. The inverted conical water flow 50 is formed inside the tubular body 32, and thus flow of the cooling water is controlled by a structure of the introduction part 36.

As illustrated in FIG. 4, a space surrounded by a frame 38 is partitioned into an outer part 44 and an inner part 46 by a boundary part 40. The outer part 44 (outer space part) is located on an outer side of the tubular body 32. The inner part 46 (inner space part) is located on an inner side of the tubular body 32. The outer part 44 and the inner part 46 communicate with each other through a passage part 42. One or a plurality of nozzles 37 communicate with the outer part 44. The cooling water is supplied from the nozzle 37 to the outer part 44, and flows from the outer part 44 to the inner part 46 through the passage part 42. An ejection part 52 is formed on a downward side of the inner part 46. The cooling water in the inner part 46 is supplied from the ejection part 52 to the inside of the tubular body 32.

An outer peripheral surface of the frame 38 is a flow passage surface 38*b* that guides flow of the cooling water in the inner part 46. A convex part 38*a*1 is formed in a lower end 38*a* of the frame 38. The convex part 38*a*1 protrudes toward an inner wall 33 of the tubular body 32. A surface of the convex part 38*a*1 facing the inner part 46 is a deflection surface 62. The deflection surface 62 is continuous to a flow passage surface 38*b*, and changes a direction of the cooling water passing through the flow passage surface 38*b*. A ring-shaped gap is formed between a tip end of the convex part 38*a*1 and the inner wall 33 of the tubular body 32. The ring-shaped gap corresponds to the ejection part 52 of the cooling water.

The convex part 38*a*1 of the frame 38 protrudes toward the inner wall 33 of the tubular body 32, and a width D1 of the ejection part 52 is narrower than a width D2 of the inner part 46. Due to this structure, the cooling water passing through the flow passage surface 38*b* can be directed by the deflection surface 62. As a result, the cooling water collides with the inner wall 33 of the tubular body 32, and is reflected to an inner side of the tubular body 32.

Since the cooling water passes through the above-described flow passage, the cooling water supplied from the ejection part 52 to the inside of the tubular body 32 becomes the inverted conical water flow 50. In a case where D1 equals to D2, the cooling water supplied from the ejection part 52 to the inside of the tubular body 32 flows in parallel to the inner wall of the tubular body 32, and thus the inverted conical water flow 50 is less likely to be formed.

From the viewpoint that the inverted conical water flow 50 is likely to be formed, D1/D2 may be from 1/10 to 2/3, and preferably from 1/10 to 1/2.

The cooling water supplied from the ejection part 52 to the inside of the tubular body 32 may flow straightly toward the central axial line O of the tubular body 32. The inverted conical water flow 50 may be a water flow that circulates around the central axial line O without flowing straightly.

In the gas atomizing method, a particle size and a particle size distribution of the soft magnetic metal powder may be controlled by a pressure of the high-pressure gas 26*a*, a dropping amount of the molten metal 21 per unit time, a pressure of the water flow 50, or the like.

After carrying out the gas atomizing method, a heat treatment on the soft magnetic metal powder may be performed. Due to the heat treatment on the soft magnetic metal powder, a nanocrystal phase is likely to precipitate in the metal particle 2 of the soft magnetic metal particle 1. For example, a part or the entirety of amorphous phases may be changed into the nanocrystal phase due to the heat treatment. A plurality of nanocrystal phases may precipitate in an amorphous phase, and a nanohetero structure may be formed in the metal particle 2 due to the heat treatment. From the viewpoint that the nanocrystal phase is likely to precipitate in the metal particle 2, the soft magnetic metal powder may be heated at a heat treatment temperature of from 400° C. to 650° C. From the same reason, time for which the temperature of the soft magnetic metal powder is maintained at the heat treatment temperature may be from 0.1 hours to 10 hours. The heat treatment on the soft magnetic metal powder may be performed in an inert gas. In a case where the heat treatment also serves for oxidization of the surface of the soft magnetic metal particle 1, the heat treatment on the soft magnetic metal powder may be performed in an oxidizing atmosphere (for example, the air). That is, due to the heat treatment, the oxidized part 3 covering the metal particle 2 may be formed. Precipitation of the nanocrystal phase in the heat treatment can be promoted by adjusting a temperature of the high-pressure gas 26*a*, a pressure of the high-pressure gas 26*a*, a pressure of the water flow 50, or the like.

After carrying out the gas atomizing method, the surface of the oxidized part 3 of each soft magnetic metal particle 1 (uncoated particle) may be covered with the coating part 4. For example, a method for forming the coating part 4 may be at least one kind selected from the group consisting of a powder sputtering method, a sol-gel method, a mechanochemical coating method, a phosphate treatment method, an immersing method, and a heat treatment method. For example, in a case where the coating part 4 consists of a plurality of coating layers having compositions different from each other, the coating part 4 may be formed by a combination of a plurality of methods.

In the mechanochemical coating method, a mixture (powder) of uncoated particles and a raw material of the coating part is contained in a container of a powder coating device. When the container is rotated, the mixture is compressed between a grinder provided in the container and an inner wall of the container, and a frictional heat occurs in the mixture. The raw material of the coating part is softened due to the frictional heat. In addition, when the raw material of the coating part is fixed to the surface of the coated particles (the surface of the oxidized part 3) due to a compression operation, the coating part 4 is formed. The frictional heat can be controlled by adjusting a rotation speed of the container, and a distance between the grinder and the inner wall of the container. The frictional heat may be controlled in correspondence with a composition of the raw material of the coating part.

[Water Atomizing Method]

The soft magnetic metal powder may be produced by a water atomizing method instead of the above-described gas atomizing method. In the water atomizing method, a molten metal is formed by melting a metal raw material as in the gas atomizing method. When forming the molten metal, a crucible may be used.

In the water atomizing method, the molten metal sprayed from a nozzle is caused to collide with a high-pressure water flow. As a result, the molten metal becomes a plurality of fine liquid droplets, and the fine liquid droplets are rapidly cooled by the water flow and are solidified. The water flow includes at least one of Ca and Mg. At least one of Ca and Mg may be included in the water flow as ions. In addition, when the liquid droplets (molten metal) and the water flow come into contact with each other, at least one of Ca and Mg adheres to a surface of the liquid droplets. In addition, the surface of the liquid droplets may be oxidized due to contact between the liquid droplets and the water flow. Alternatively, after the metal particle 2 to which at least one of Ca and Mg adheres is formed, the surface of the metal particle 2 may be naturally oxidized in the air.

Due to the above-described rapid cooling of the liquid droplets (and the subsequent natural oxidization), a plurality of the soft magnetic metal particles 1 (uncoated particles) including the oxidized part 3 and the metal particle 2 coated with the oxidized part 3 are formed.

A composition of the water flow that is used in the water atomizing method may be the same as the composition of the cooling water that is used in the gas atomizing method.

In the water atomizing method, a particle size and a particle size distribution of the soft magnetic metal powder may be controlled by adjusting a pressure of the water flow, a spraying amount of the molten metal per unit time, or the like. For example, the pressure of the water flow may be from 50 MPa to 100 MPa. For example, the spraying amount of the molten metal may be from 1 kg/minute to 20 kg/minute.

After carrying out the water atomizing method, a heat treatment on the soft magnetic metal powder may be performed for the same purpose as in the heat treatment that is performed after carrying out the gas atomizing method. From the viewpoint that the nanocrystal phase is likely to precipitate in the metal particle 2, the soft magnetic metal powder may be heated at a heat treatment temperature of from 350° C. to 800° C. From the same reason, time for which the temperature of the soft magnetic metal powder is maintained in the temperature range may be from 0.1 minutes to 120 minutes.

As is the case with the gas atomizing method, after carrying out the water atomizing method, the surface of the oxidized part 3 of the soft magnetic metal particle 1 (uncoated particle) may be coated with the coating part 4.

(Electronic Component)

An electronic component according to this embodiment includes the soft magnetic metal powder. For example, the electronic component may be an inductor, a transformer, a choke coil, and an electromagnetic interference (EMI) filter. The electronic components may include a coil, and a magnetic core that is disposed on an inner side of the coil. The magnetic core may include the soft magnetic metal powder. For example, the magnetic core may include the soft magnetic metal powder and a binder. The binder binds a plurality of soft magnetic alloy particles included in the soft magnetic metal powder. For example, the binder may include a thermosetting resin such as an epoxy resin. The inner side of the coil may be filled with a mixture of the soft magnetic metal powder and the binder, and the entirety of the coil may be coated with the mixture of the soft magnetic metal powder and the binder. The electronic component may be a magnetic head or an electromagnetic wave shield.

Examples

The invention will be described in more detail with reference to the following examples and comparative examples. However, the invention is not limited to the following examples.

Soft magnetic metal powders of Samples 1 to 206 were respectively produced and analyzed by the following method. However, Samples 86 and 97 to 99 do not exist.

(Composition of Metal Raw Material)

Metal raw materials of the soft magnetic metal powders of Samples 1 to 44 and 193 to 206 were prepared by mixing a plurality of kinds of raw materials in a predetermined ratio. A composition of the entirety of the metal raw material of each of Samples 1 to 44 and 193 to 206 is expressed by the following Chemical Formula 1. In the following Chemical Formula 1, h equals to a+b+≤c+d+e+f. In any of Samples 1 to 44, and 193 to 206, M in Chemical Formula 1 was Nb. In any of Samples 1 to 44, each of α, β, d, e, and f in Chemical Formula 1 was zero. a, b, c, and 1−h in Chemical Formula 1 of each of Samples 1 to 44 were values shown in the following Table 1 and Table 2. a, b, c, d, e, f, and 1−h in Chemical Formula 1 of each of Samples 193 to 206 were values shown in the following Table 11.

$$(Fe_{(1-(\alpha+\beta))}X1_{\alpha}X2_{\beta})_{(1-h)}M_aB_bP_cSi_dC_eS_f \quad (1)$$

A metal raw material of a soft magnetic metal powder of each of Samples 45 to 56 was prepared by mixing a plurality of kinds of raw materials in a predetermined ratio. A composition of the entirety of the metal raw material of each of Samples 45 to 56 is described in a column of "Composition" in the following Table 3.

A metal raw material of a soft magnetic metal powder of each of Samples 57 to 109, 191, and 192 was prepared by mixing a plurality of kinds of raw materials in a predetermined ratio. A composition of the entirety of the metal raw material of each of Samples 57 to 109, 191, and 192 is expressed by Chemical Formula 1 described above. In any of Samples 57 to 109, 191, and 192, M in Chemical Formula 1 was Nb. In any of Samples 57 to 109, 191, and 192, each of α and β in Chemical Formula 1 was zero. a, b, c, d, e, f, and 1−h in Chemical Formula 1 of each of Samples 57 to 109, 191, and 192 were values shown in the following Table 4, Table 5, Table 6, or Table 10. Compositions of the entirety of the metal raw materials of Samples 57, 191, and 192 were the same as each other.

Metal raw materials of the soft magnetic metal powders of Samples 110 to 136 were prepared by mixing a plurality of kinds of raw materials in a predetermined ratio. A composition of the entirety of the metal raw material of each of Samples 110 to 136 is expressed by Chemical Formula 1 described above.

The composition of the entirety of the metal raw material of each of Samples 110 to 118 was the same as the composition of the entirety of the metal raw material of Sample 59 except for the kind of the element M. The element M in Chemical Formula 1 of each of Samples 110 to 118 is shown in the following Table 7.

The composition of the entirety of the metal raw material of each of Samples 119 to 127 was the same as the composition of the entirety of the metal raw material of Sample 57 except for the kind of the element M. The element M in Chemical Formula 1 of each of Samples 119 to 127 is shown in the following Table 7.

The composition of the entirety of the metal raw material of each of Samples 128 to 136 was the same as the composition of the entirety of the metal raw material of Sample 63 except for the kind of the element M. The element M in Chemical Formula 1 of each of Samples 128 to 136 is shown in the following Table 7.

Metal raw materials of the soft magnetic metal powders of Samples 137 to 190 were prepared by mixing a plurality of kinds of raw materials in a predetermined ratio. A composition of the entirety of the metal raw material of each of Samples 137 to 190 is expressed by Chemical Formula 1 described above.

The metal raw material of each of Samples 137 to 142 included an element X1 shown in the following Table 8. α(1−h) in Chemical Formula 1 of each of Samples 137 to 142 was a value shown in the following Table 8.

The metal raw material of each of Samples 143 to 174 included an element X2 shown in the following Table 8 or Table 9. β(1−h) in Chemical Formula 1 of each of Samples 143 to 174 was adjusted to a value shown in the following Table 8 or Table 9.

The metal raw material of each of Samples 175 to 190 included the element X1 and the element X2 shown in the following Table 9. α(1−h) and β(1−h) in Chemical Formula 1 of each of Samples 175 to 190 were values shown in the following Table 9.

A composition of the entirety of the metal raw material of each of Samples 137 to 190 was the same as the composition of the entirety of the metal raw material of Sample 57 except for the above-described configurations.

(Atomizing Method)

In the case of Samples 1 to 11, 193, 194, and 201 to 203, a soft magnetic metal powder (uncoated particles) of each sample was produced by the gas atomizing method using the metal raw material of the each sample. In production of Samples 1 to 11, 193, 194, and 201 to 203, the following heat treatment was not performed. In the gas atomizing method, the gas atomizing apparatus illustrated in FIG. 3 and FIG. 4 was used. Details of the gas atomizing method were as follows.

The metal raw material was contained in the container 22. The metal raw material in the container 22 was heated by high frequency induction using the coil 24, and the molten metal 21 was obtained. A temperature of the molten metal 21 was 1500° C.

After the atmosphere inside the tubular body 32 of the cooling unit 30 was evacuated, cooling water was supplied from the introduction part 36 to the inside of the tubular body 32, and thus the water flow 50 was formed inside the tubular body 32. A shape of the water flow 50 was an inverted cone. A pressure (pump pressure) of the water flow 50 was 7.5 MPa. An inner diameter of the tubular body 32 was 300 mm. A ratio (D1/D2) of D1 and D2 in FIG. 4 was 1/2. An angle θ1 in FIG. 4 was 20°.

Calcium carbonate ($CaCO_3$) was added to the cooling water (water flow 50) in advance. The content (unit: mg/liter) of $CaCO_3$ contained in the cooling water used in production of each sample is described in a column of "$CaCO_3$" in the following tables.

The molten metal 21 was supplied dropwise from the ejection port of the container 22 toward the cooling unit 30. In addition, the high-pressure gas 26*a* is sprayed from the gas nozzle 26 to the molten metal 21. The high-pressure gas 26*a* was an argon gas. A pressure of the high-pressure gas 26*a* was 5 MPa. Due to the spraying of the high-pressure gas 26*a*, the molten metal 21 was converted into a plurality of fine liquid droplets 21*a*. The liquid droplets 21*a* were moved to the inside of the tubular body 32 of the cooling unit 30 along the high-pressure gas 26*a*. The liquid droplets 21*a* collide with the inverted conical water flow 50 inside the tubular body 32, and thus the liquid droplets 21*a* were decomposed into finer liquid droplets. The fine liquid droplets were rapidly cooled by the water flow 50 and were solidified, and thus a soft magnetic metal powder (uncoated particles) was obtained. The water flow 50 (cooling water) including the soft magnetic metal powder is discharged from the discharge part 34 to the outside of the tubular body 32, and the soft magnetic metal powder was recovered from the cooling water.

In the case of Samples 12 to 22, 195, 196, and 204 to 206, a soft magnetic metal powder was obtained by the gas atomizing method using the metal raw material of each sample, and then a heat treatment on the soft magnetic metal powder was performed. The gas atomizing method carried out in production of Samples 12 to 22, 195, 196, and 204 to 206 was the same as in the above-described method. The content of $CaCO_3$ in the cooling water used in production of each sample is described in a column of "$CaCO_3$" in the following tables. In the heat treatment, the soft magnetic metal powder was heated up to 600° C. at a temperature rising rate of 5 K/minute, and the temperature of the soft magnetic metal powder was maintained at 600° C. for one hour.

In the case of Samples 12 to 22, 195, 196, and 204 to 206, the soft magnetic metal powder represents a soft magnetic metal powder after being subjected to the heat treatment.

In the case of Samples 23 to 33, 197, and 198, a soft magnetic metal powder (uncoated particles) of each sample was produced by the gas atomizing method using the metal raw material of the each sample. In production of Samples 23 to 33, 197, and 198, the above-described heat treatment was not performed. In the case of Samples 23 to 33, 197, and 198, magnesium carbonate ($MgCO_3$) instead of $CaCO_3$ was added to the cooling water (water flow 50) in advance. The content (unit: mg/liter) of $MgCO_3$ in the cooling water used in production of each sample is described in a column of "$MgCO_3$" in the following tables. The gas atomizing method carried out in production of Samples 23 to 33, 197, and 198 was the same as in the above-described method except for the composition of the cooling water.

In the case of Samples 34 to 44, 199, and 200, a soft magnetic metal powder was obtained by the gas atomizing method using the metal raw material of each sample, and then a heat treatment on the soft magnetic metal powder was performed. In the case of Samples 34 to 44, 199, and 200, $MgCO_3$ instead of $CaCO_3$ was added to the cooling water (water flow 50) in advance. The content of $MgCO_3$ in the cooling water used in production of each sample is described in a column of "$MgCO_3$" in the following tables. The gas atomizing method carried out in production of Samples 34 to 44, 199, and 200 was the same as in the above-described method except for the composition of the cooling water. A method of the heat treatment performed in production of Samples 34 to 44, 199, and 200 was the same as the above-described method. In the case of Samples 34 to 44, 199, and 200, the soft magnetic metal powder represents a soft magnetic metal powder after being subjected to the heat treatment.

In the case of Samples 45 to 48, a soft magnetic metal powder (uncoated particles) of each sample was produced by the gas atomizing method using the metal raw material of the each sample. In production of Samples 45 to 48, the above-described heat treatment was not performed. In the case of Samples 45 to 48, $CaCO_3$ and $MgCO_3$ were added to the cooling water (water flow 50) in advance. The content of $CaCO_3$ in the cooling water used in production of each sample is described in a column of "$CaCO_3$" in the following tables. The content of $MgCO_3$ in the cooling water used in production of each sample is described in a column of "$MgCO_3$" in the following tables. The gas atomizing method carried out in production of Samples 45 to 48 was the same as the above-described method except for the composition of the cooling water.

In the case of Samples 49 to 52, a soft magnetic metal powder was obtained by the gas atomizing method using the metal raw material of each sample, and then a heat treatment on the soft magnetic metal powder was performed. In the case of Samples 49 to 52, $CaCO_3$ and $MgCO_3$ were added to the cooling water (water flow 50) in advance. The content of $CaCO_3$ in the cooling water used in production of each sample is described in a column of "$CaCO_3$" in the following tables. The content of $MgCO_3$ in the cooling water used in production of each sample is described in a column of "$MgCO_3$" in the following tables. The gas atomizing method carried out in production of Samples 49 to 52 was the same as the above-described method except for the composition of the cooling water. A method of the heat treatment carried out in production of Samples 49 to 52 was the same as in the above-described method. In the case of Samples 49 to 52, the soft magnetic metal powder represents a soft magnetic metal powder after being subjected to the heat treatment.

In the case of Samples 53 to 56, a soft magnetic metal powder (uncoated particles) of each sample was produced by a water atomizing method using the metal raw material of the each sample. In production of Samples 53 to 56, the above-described heat treatment was not performed. Details of the water atomizing method were as follows.

A metal raw material was contained in a crucible. The metal raw material in the crucible was heated by high frequency induction using a coil, and a molten metal was obtained. A temperature of the molten metal was 1500° C. The molten metal sprayed from a nozzle formed on a downward side of the crucible was caused to collide with a high-pressure water flow (cooling water). As a result, the molten metal becomes a plurality of fine liquid droplets. The fine liquid droplets were rapidly cooled by the water flow and were solidified, and thus a soft magnetic metal powder (uncoated particles) was obtained. The soft magnetic metal powder was recovered from the cooling water.

$CaCO_3$ and $MgCO_3$ were added to the cooling water used in the water atomizing method in advance. The content of $CaCO_3$ in the cooling water used in production of each sample is described in a column of "$CaCO_3$" in the following tables. The content of $MgCO_3$ in the cooling water used in production of each sample is described in a column of "$MgCO_3$" in the following tables.

In the case of Samples 57 to 192, a soft magnetic metal powder was obtained by the gas atomizing method using the metal raw material of each sample, and a heat treatment on the soft magnetic metal powder was performed. In the case of Samples 57 to 192, $CaCO_3$ and $MgCO_3$ were added to the cooling water (water flow 50) in advance. The content of $CaCO_3$ in the cooling water used in production of each sample was 2000 mg/liter. The content of $MgCO_3$ in the cooling water used in production of each sample was 400 mg/liter. The gas atomizing method carried out in production of Samples 57 to 192 was the same as the above-described method except for the composition of the cooling water. A method of the heat treatment performed in production of Samples 57 to 192 was the same as the above-described method. In the case of Samples 57 to 192, the soft magnetic metal powder represents a soft magnetic metal powder after being subjected to the heat treatment.

(Analysis of Soft Magnetic Metal Powder)

The soft magnetic metal powder (uncoated particles) of each of Samples 1 to 206 was analyzed by the following method.

Figure 5:
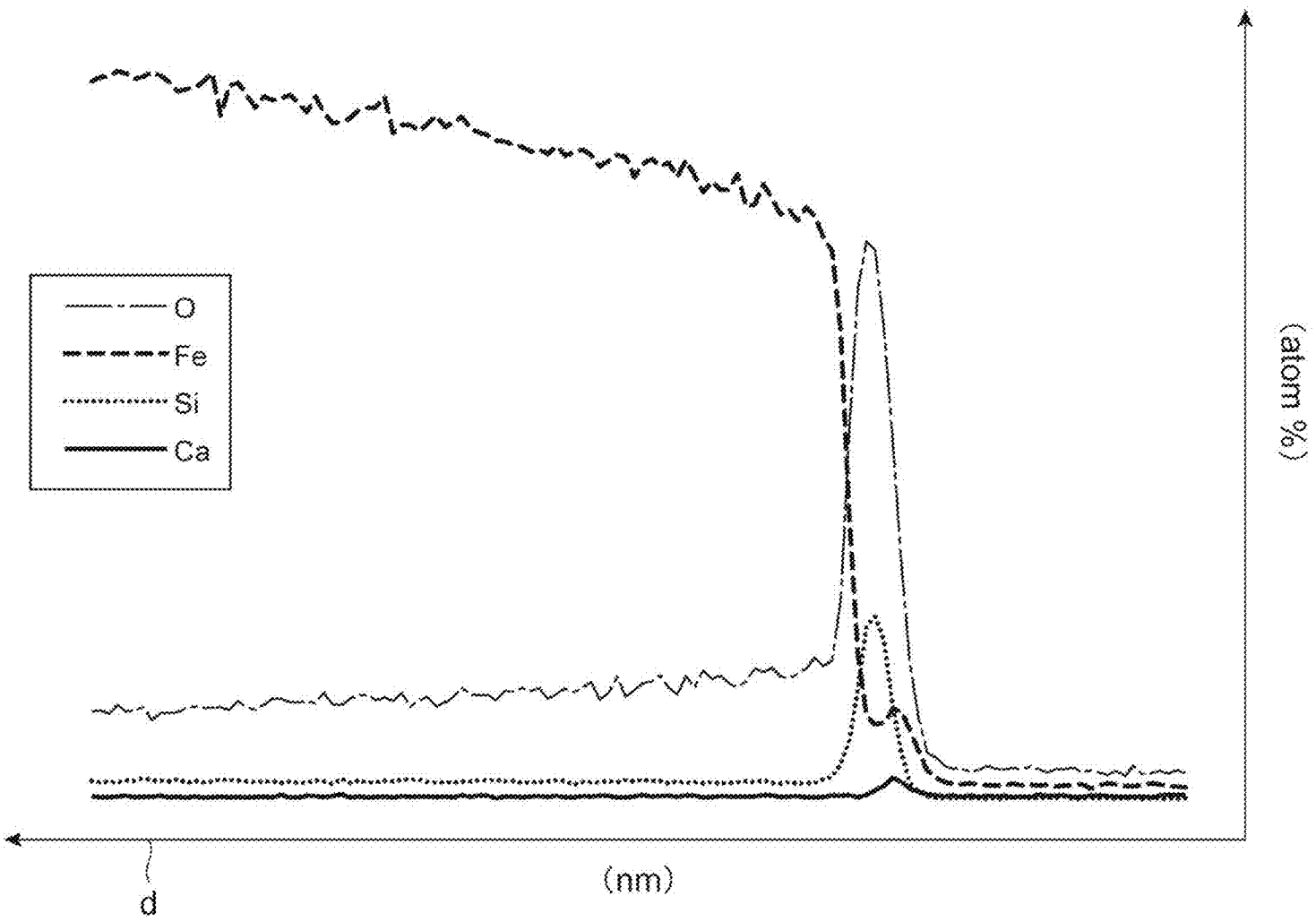
FIG. 5 is a graph showing concentration distributions of respective elements in a direction orthogonal to an outermost surface of an oxidized part of the soft magnetic metal particle.

A mixture of the soft magnetic metal powder and a thermosetting resin was molded, and the thermosetting resin was cured, thereby obtaining a molded body. The molded body was processed by ion milling, thereby obtaining a thin film (measurement sample). Cross-sections of twenty soft magnetic metal particles included in the thin film were observed with STEM. In the cross-section of each of the observed soft magnetic metal particles, a concentration distribution of each element was measured. The concentration distribution of each element was measured along a direction orthogonal to an outermost surface of the soft magnetic metal particle. That is, as illustrated in FIG. 1, the concentration distribution of each element was measured along a line segment that extends in the depth direction d and crosses the soft magnetic metal particle 1. An interval between measurement points was approximately 0.5 nm. EDS was used in measurement of the concentration distribution of each element. A unit of the concentration of the element is atom %. As an example of the concentration distribution, a concentration distribution of each element in the soft magnetic metal particle of Sample 10 is shown in FIG. 5. As shown in FIG. 5, a peak (maximum value) of the concentration of each of Ca, Si, and O existed. The peak of the concentration of each of Ca, Si, and O was measured in a region in which a depth from an outermost surface of the soft magnetic metal particle is within approximately 10 nm. Particularly, the peak of the concentration of Ca was measured in a region in which the depth from the outermost surface of the soft magnetic metal particle is within approximately 2 nm.

Results of the above analysis showed the soft magnetic metal particle of each of Samples 1 to 206 consisted of a metal particle and an oxidized part covering the entirety of the metal particle. In any of Samples 1 to 206, a composition of the metal particle approximately matched the composition of the entirety of the metal raw material. In any of Samples 1 to 206, the oxidized part included an oxide of at least one kind of element selected from the group consisting of Fe, Si, and B. For example, the oxidized part of each of Samples 201 to 206 is constituted by Fe, Si, B, Ca, and O. In a case where Ca or Mg was detected from the soft magnetic metal particle, the concentration of Ca or Mg in the uncoated particles was maximum in the oxidized part. In all examples, the concentration of Ca or Mg in the uncoated particles was maximum in a region of the outermost surface of the oxidized part.

An average value of a maximum value of the concentration of Ca was calculated from a maximum value of the concentration of Ca which was measured in the oxidized part of each of twenty soft magnetic metal particles. The average value of the maximum value of the concentration of Ca in the oxidized part of each sample is described in a column of [Ca] in the following tables. Ca was not detected in an oxidized part of a sample in which the column of [Ca] in the following tables is empty. In addition, in the oxidized part of a sample in which zero is described in the column of [Ca] in the following tables, Ca was not detected in the oxidized part.

An average value of a maximum value of the concentration of Mg was calculated from a maximum value of the concentration of Mg which was measured in the oxidized part of each of twenty soft magnetic metal particles. The average value of the maximum value of the concentration of Mg in the oxidized part of each sample is described in a column of [Mg] in the following tables. Mg was not detected in an oxidized part of a sample in which the column of [Mg] in the following tables is empty. In addition, in the oxidized part of a sample in which zero is described in the column of [Mg] in the following tables, Mg was not detected in the oxidized part.

An X-ray diffraction pattern of each of Samples 1 to 56, and 193 to 206 was measured by using a powder X-ray diffraction device. A crystal structure of the soft magnetic metal powder of each of Samples 1 to 56, and 193 to 206 was analyzed on the basis of X-ray diffraction pattern of each of Samples 1 to 56, and 193 to 206 and observation on the soft magnetic metal particle with the STEM. Results are shown in a column of "Crystal structure" in the following tables. "Amorphous" described in the column of "Crystal structure" represents that a crystal having a grain size more than 30 nm is not detected from the soft magnetic metal particles, and a diffraction X-ray derived from a body-centered cubic lattice structure is not detected. "Nanocrystal" described in the column of "Crystal structure" represents that an average grain size of crystals included in the soft magnetic metal particles is 5 to 30 nm, and the diffraction X-ray derived from the body-centered cubic lattice structure is detected. "Crystal" described in the column of "Crystal structure" represents that a crystal having a grain size more than 30 nm is detected from the soft magnetic metal particle, an average grain size of crystals included in the soft magnetic metal particles is more than 30 nm, and the diffraction X-ray derived from the body-centered cubic lattice structure is detected.

(Measurement of Magnetic Characteristics)

A coercivity and saturation magnetization of the soft magnetic metal powder (uncoated particles) of each of Samples 1 to 206 were measured by the following method.

20 g of soft magnetic metal powder (uncoated particles) and paraffin were contained in a tubular plastic case. An inner diameter ϕ of the plastic case was 6 mm, and a length of the plastic case was 5 mm. The paraffin inside the plastic case was melted through heating, and then the paraffin was solidified to obtain a measurement sample. A coercivity and saturation magnetization of the measurement sample were measured. In measurement of the coercivity, a coercivity meter (K-HC 1000 type) manufactured by Tohoku Steel Co., Ltd. was used. A measurement magnetic field was 150 kA/m. In the measurement of the saturation magnetization, VSM (vibration sample magnetometer) manufactured by TAMAKAWA CO., LTD. was used. The coercivity Hc (unit: A/m) of each of Samples 1 to 206 is shown in the following tables. Saturation magnetization σs (unit: $A \cdot m^2/kg$) per unit mass of each of Samples 1 to 206 is shown in the following tables. It is preferable that the coercivity Hc is low and the saturation magnetization σs is high.

(Measurement of Withstand Voltage of Uncoated Particles)

The withstand voltage of the soft magnetic metal powder (uncoated particles) of each of Samples 1 to 56, and 193 to 206 was measured by the following method.

An epoxy resin (thermosetting resin), an imide resin (curing agent), and acetone were mixed to prepare a solution. The solution was mixed with the soft magnetic metal powder (uncoated particles), and then the acetone was vaporized to obtain a granulated powder. The total mass of the epoxy resin and the imide resin was 3 parts by mass with respect to 100 parts by mass of soft magnetic metal powder. The granulated powder was size-regulated by using a mesh. A mesh opening of the mesh was 355 μm. A molded body was obtained through molding of the size-regulated granulated powder by using a toroidal mold. An inner diameter of the mold was 6.5 mm, and an outer diameter of the mold was 11 mm. A molding pressure was 3.0 $t/cm^2$. The molded body was heated at 180° C. for one hour to cure the epoxy resin. A dust core was obtained by the above-described method.

A voltage was applied to the dust core by using a source meter. A current in the dust core was continuously measured while continuously increasing the voltage. A withstand voltage of the dust core is defined as a voltage when a current in the dust core reaches 1 mA. A withstand voltage V1 (unit: V/mm) of the soft magnetic metal powder (uncoated particles) of each of Samples 1 to 56, and 193 to 206 is shown in the following tables. It is preferable that V1 is high.

(Formation of Coating Part)

A coating part was formed on the entirety of a surface of the uncoated particles (soft magnetic metal powder) of each of Samples 1 to 206 by a mechanochemical coating method. As a raw material of the coating part, powder glass was used. That is, the entirety of the oxidized part of the uncoated particles of each of Samples 1 to 206 was covered with the coating part consisting of the glass. The mass of the powder glass was 0.5 parts by mass with respect to 100 parts by mass of uncoated particles (soft magnetic metal powder). The thickness of the coating part was approximately 50 nm.

The powder glass used in formation of the coating part of each of Samples 1 to 190, and 193 to 206 was phosphate-based glass. Main components of the phosphate-based glass are expressed as $P_2O_5$—ZnO—$R_2O$—$Al_2O_3$. R is an alkali metal. The content of $P_2O_5$ in the phosphate-based glass was 50% by mass. The content of ZnO in the phosphate-based glass was 12% by mass. The content of $R_2O$ contained in the phosphate-based glass was 20% by mass. The content of $Al_2O_3$ in the phosphate-based glass was 6% by mass. In addition to the four components, 12% by mass of sub-component was included in the phosphate-based glass.

The powder glass used in formation of the coating part of Sample 191 was bismuthate-based glass. Main components of the bismuthate-based glass are expressed as $Bi_2O_3$—ZnO—$B_2O_3$—$SiO_2$. The content of $Bi_2O_3$ in the bismuthate-based glass was 80% by mass. The content of ZnO in the bismuthate-based glass was 10% by mass. The content of $B_2O_3$ in the bismuthate-based glass was 5% by mass. The content of $SiO_2$ in the bismuthate-based glass was 5% by mass.

The powder glass used in formation of the coating part of Sample 192 was borosilicate-based glass. Main components of the borosilicate-based glass are expressed as BaO—ZnO—$B_2O_3$—$SiO_2$—$Al_2O_3$. The content of BaO in the borosilicate-based glass was 8% by mass. The content of ZnO in the borosilicate-based glass was 23% by mass. The content of $B_2O_3$ in the borosilicate-based glass was 19% by mass. The content of $SiO_2$ in the borosilicate-based glass was 16% by mass. The content of $Al_2O_3$ in the borosilicate-based glass was 6% by mass. The borosilicate-based glass further included a sub-component as the remainder other than the main components.

As to be described later, the coated particle of each of Samples 191 and 192 had high V2 as in the coated particle (example) including the phosphate-based glass as the coating part.

(Measurement of Withstand Voltage of Coated Particle)

After forming the coating part, a withstand voltage V2 of the soft magnetic metal powder (coated particles) of each of Samples 1 to 206 was measured. A measurement method of the withstand voltage V2 of the coated particles was similar to the measurement method of the withstand voltage V1 of the uncoated particles. The withstand voltage V2 (unit: V/mm) of the soft magnetic metal powder (coated particles) of each of Samples 1 to 206 is shown in the following tables. It is preferable that V2 is high.

ΔV of each of Samples 1 to 56 and 193 to 206 is shown in the following tables. As described above, ΔV is V2–V1. It is preferable that ΔV is high.

All of Samples 57 to 192 described in Table 4, Table 5, Table 6, Table 7, Table 8, Table 9, or Table 10 are examples.

TABLE 1

| Samples | Classification | Fe 1-h | M (Nb) a | B b | P c | Si d | C e | S f | $CaCO_3$ mg/l | Crystal structure — | Hc A/m | σs A · $m^2$/kg | [Ca] Atom % | V1 V/mm | V2 V/mm | ΔV V/mm |
|---|---|---|---|---|---|---|---|---|---|---|---|---|---|---|---|---|
| 1 | Comparative Example | 0.800 | 0.060 | 0.090 | 0.050 | 0.000 | 0.000 | 0.000 | 20 | Amorphous | 175 | 173 | 0.0 | 119 | 344 | V/225 |
| 2 | Comparative Example | 0.800 | 0.060 | 0.090 | 0.050 | 0.000 | 0.000 | 0.000 | 50 | Amorphous | 171 | 177 | 0.0 | 118 | 342 | 224 |
| 3 | Comparative Example | 0.800 | 0.060 | 0.090 | 0.050 | 0.000 | 0.000 | 0.000 | 100 | Amorphous | 168 | 174 | 0.0 | 122 | 346 | 224 |
| 4 | Comparative Example | 0.800 | 0.060 | 0.090 | 0.050 | 0.000 | 0.000 | 0.000 | 200 | Amorphous | 167 | 171 | 0.0 | 120 | 350 | 230 |
| 5 | Comparative Example | 0.800 | 0.060 | 0.090 | 0.050 | 0.000 | 0.000 | 0.000 | 400 | Amorphous | 170 | 175 | 0.0 | 121 | 347 | 226 |
| 6 | Comparative Example | 0.800 | 0.060 | 0.090 | 0.050 | 0.000 | 0.000 | 0.000 | 600 | Amorphous | 173 | 173 | 0.1 | 122 | 355 | 233 |
| 7 | Example | 0.800 | 0.060 | 0.090 | 0.050 | 0.000 | 0.000 | 0.000 | 800 | Amorphous | 172 | 170 | 0.2 | 140 | 436 | 296 |
| 8 | Example | 0.800 | 0.060 | 0.090 | 0.050 | 0.000 | 0.000 | 0.000 | 1000 | Amorphous | 169 | 174 | 0.9 | 144 | 490 | 346 |
| 9 | Example | 0.800 | 0.060 | 0.090 | 0.050 | 0.000 | 0.000 | 0.000 | 1500 | Amorphous | 174 | 170 | 2.3 | 149 | 516 | 367 |
| 10 | Example | 0.800 | 0.060 | 0.090 | 0.050 | 0.000 | 0.000 | 0.000 | 2000 | Amorphous | 173 | 176 | 5.1 | 155 | 521 | 366 |
| 11 | Example | 0.800 | 0.060 | 0.090 | 0.050 | 0.000 | 0.000 | 0.000 | 2500 | Amorphous | 175 | 173 | 5.0 | 152 | 513 | 361 |
| 193 | Example | 0.800 | 0.060 | 0.090 | 0.050 | 0.000 | 0.000 | 0.000 | 3000 | Amorphous | 174 | 175 | 8.8 | 145 | 472 | 327 |
| 194 | Reference Example | 0.800 | 0.060 | 0.090 | 0.050 | 0.000 | 0.000 | 0.000 | 4000 | Amorphous | 176 | 172 | 10.6 | 129 | 345 | 216 |
| 12 | Comparative Example | 0.800 | 0.060 | 0.090 | 0.050 | 0.000 | 0.000 | 0.000 | 20 | Nanocrystal | 140 | 173 | 0.0 | 117 | 341 | 224 |
| 13 | Comparative Example | 0.800 | 0.060 | 0.090 | 0.050 | 0.000 | 0.000 | 0.000 | 50 | Nanocrystal | 137 | 177 | 0.0 | 119 | 343 | 224 |
| 14 | Comparative Example | 0.800 | 0.060 | 0.090 | 0.050 | 0.000 | 0.000 | 0.000 | 100 | Nanocrystal | 134 | 174 | 0.0 | 121 | 346 | 225 |
| 15 | Comparative Example | 0.800 | 0.060 | 0.090 | 0.050 | 0.000 | 0.000 | 0.000 | 200 | Nanocrystal | 134 | 171 | 0.0 | 117 | 343 | 226 |
| 16 | Comparative Example | 0.800 | 0.060 | 0.090 | 0.050 | 0.000 | 0.000 | 0.000 | 400 | Nanocrystal | 136 | 175 | 0.0 | 120 | 345 | 225 |
| 17 | Comparative Example | 0.800 | 0.060 | 0.090 | 0.050 | 0.000 | 0.000 | 0.000 | 600 | Nanocrystal | 138 | 173 | 0.1 | 123 | 357 | 234 |
| 18 | Example | 0.800 | 0.060 | 0.090 | 0.050 | 0.000 | 0.000 | 0.000 | 800 | Nanocrystal | 138 | 170 | 0.3 | 136 | 424 | 288 |

TABLE 1-continued

| Samples | Classification | Fe 1-h | M (Nb) a | B b | P c | Si d | C e | S f | $CaCO_3$ mg/l | Crystal structure — | Hc A/m | σs A · $m^2$/kg | [Ca] Atom % | V1 V/mm | V2 V/mm | ΔV V/mm |
|---|---|---|---|---|---|---|---|---|---|---|---|---|---|---|---|---|
| 19 | Example | 0.800 | 0.060 | 0.090 | 0.050 | 0.000 | 0.000 | 0.000 | 1000 | Nanocrystal | 135 | 174 | 1.1 | 140 | 487 | 347 |
| 20 | Example | 0.800 | 0.060 | 0.090 | 0.050 | 0.000 | 0.000 | 0.000 | 1500 | Nanocrystal | 139 | 170 | 2.1 | 145 | 511 | 366 |
| 21 | Example | 0.800 | 0.060 | 0.090 | 0.050 | 0.000 | 0.000 | 0.000 | 2000 | Nanocrystal | 138 | 176 | 4.9 | 149 | 516 | 367 |
| 22 | Example | 0.800 | 0.060 | 0.090 | 0.050 | 0.000 | 0.000 | 0.000 | 2500 | Nanocrystal | 136 | 176 | 4.7 | 147 | 514 | 367 |
| 195 | Example | 0.800 | 0.060 | 0.090 | 0.050 | 0.000 | 0.000 | 0.000 | 3000 | Nanocrystal | 135 | 170 | 8.2 | 140 | 453 | 313 |
| 196 | Reference Example | 0.800 | 0.060 | 0.090 | 0.050 | 0.000 | 0.000 | 0.000 | 4000 | Nanocrystal | 138 | 173 | 10.2 | 128 | 342 | 214 |

TABLE 2

| Samples | Classification | Fe 1-h | M (Nb) a | B b | P c | Si d | C e | S f | $MgCO_3$ mg/l | Crystal structure — | Hc A/m | σs A · $m^2$/kg | [Ca] Atom % | V1 V/mm | V2 V/mm | ΔV V/mm |
|---|---|---|---|---|---|---|---|---|---|---|---|---|---|---|---|---|
| 23 | Comparative Example | 0.800 | 0.060 | 0.090 | 0.050 | 0.000 | 0.000 | 0.000 | 4 | Amorphous | 177 | 172 | 0.0 | 118 | 342 | 224 |
| 24 | Comparative Example | 0.800 | 0.060 | 0.090 | 0.050 | 0.000 | 0.000 | 0.000 | 10 | Amorphous | 169 | 175 | 0.0 | 120 | 345 | 225 |
| 25 | Comparative Example | 0.800 | 0.060 | 0.090 | 0.050 | 0.000 | 0.000 | 0.000 | 20 | Amorphous | 168 | 177 | 0.0 | 121 | 344 | 223 |
| 26 | Comparative Example | 0.800 | 0.060 | 0.090 | 0.050 | 0.000 | 0.000 | 0.000 | 40 | Amorphous | 169 | 171 | 0.0 | 120 | 346 | 226 |
| 27 | Comparative Example | 0.800 | 0.060 | 0.090 | 0.050 | 0.000 | 0.000 | 0.000 | 80 | Amorphous | 173 | 176 | 0.0 | 121 | 345 | 224 |
| 28 | Comparative Example | 0.800 | 0.060 | 0.090 | 0.050 | 0.000 | 0.000 | 0.000 | 120 | Amorphous | 173 | 174 | 0.1 | 125 | 353 | 228 |
| 29 | Example | 0.800 | 0.060 | 0.090 | 0.050 | 0.000 | 0.000 | 0.000 | 160 | Amorphous | 169 | 172 | 0.3 | 137 | 386 | 249 |
| 30 | Example | 0.800 | 0.060 | 0.090 | 0.050 | 0.000 | 0.000 | 0.000 | 200 | Amorphous | 166 | 174 | 0.4 | 139 | 390 | 251 |
| 31 | Example | 0.800 | 0.060 | 0.090 | 0.050 | 0.000 | 0.000 | 0.000 | 300 | Amorphous | 174 | 171 | 0.4 | 141 | 416 | 275 |
| 32 | Example | 0.800 | 0.060 | 0.090 | 0.050 | 0.000 | 0.000 | 0.000 | 400 | Amorphous | 173 | 174 | 0.5 | 145 | 427 | 282 |
| 33 | Example | 0.800 | 0.060 | 0.090 | 0.050 | 0.000 | 0.000 | 0.000 | 500 | Amorphous | 175 | 170 | 0.5 | 143 | 425 | 282 |
| 197 | Example | 0.800 | 0.060 | 0.090 | 0.050 | 0.000 | 0.000 | 0.000 | 1000 | Amorphous | 177 | 172 | 1.4 | 139 | 401 | 262 |
| 198 | Reference Example | 0.800 | 0.060 | 0.090 | 0.050 | 0.000 | 0.000 | 0.000 | 1500 | Amorphous | 170 | 175 | 2.1 | 127 | 355 | 228 |
| 34 | Comparative Example | 0.800 | 0.060 | 0.090 | 0.050 | 0.000 | 0.000 | 0.000 | 4 | Nanocrystal | 139 | 176 | 0.0 | 115 | 339 | 224 |
| 35 | Comparative Example | 0.800 | 0.060 | 0.090 | 0.050 | 0.000 | 0.000 | 0.000 | 10 | Nanocrystal | 136 | 176 | 0.0 | 116 | 342 | 226 |
| 36 | Comparative Example | 0.800 | 0.060 | 0.090 | 0.050 | 0.000 | 0.000 | 0.000 | 20 | Nanocrystal | 134 | 178 | 0.0 | 118 | 345 | 227 |
| 37 | Comparative Example | 0.800 | 0.060 | 0.090 | 0.050 | 0.000 | 0.000 | 0.000 | 40 | Nanocrystal | 132 | 169 | 0.0 | 117 | 343 | 226 |
| 38 | Comparative Example | 0.800 | 0.060 | 0.090 | 0.050 | 0.000 | 0.000 | 0.000 | 80 | Nanocrystal | 136 | 175 | 0.0 | 119 | 346 | 227 |
| 39 | Comparative Example | 0.800 | 0.060 | 0.090 | 0.050 | 0.000 | 0.000 | 0.000 | 120 | Nanocrystal | 138 | 172 | 0.1 | 123 | 350 | 227 |
| 40 | Example | 0.800 | 0.060 | 0.090 | 0.050 | 0.000 | 0.000 | 0.000 | 160 | Nanocrystal | 135 | 178 | 0.2 | 135 | 374 | 239 |
| 41 | Example | 0.800 | 0.060 | 0.090 | 0.050 | 0.000 | 0.000 | 0.000 | 200 | Nanocrystal | 131 | 174 | 0.4 | 137 | 381 | 244 |
| 42 | Example | 0.800 | 0.060 | 0.090 | 0.050 | 0.000 | 0.000 | 0.000 | 300 | Nanocrystal | 136 | 174 | 0.5 | 138 | 399 | 261 |
| 43 | Example | 0.800 | 0.060 | 0.090 | 0.050 | 0.000 | 0.000 | 0.000 | 400 | Nanocrystal | 138 | 179 | 0.6 | 142 | 416 | 274 |
| 44 | Example | 0.800 | 0.060 | 0.090 | 0.050 | 0.000 | 0.000 | 0.000 | 500 | Nanocrystal | 135 | 176 | 0.6 | 140 | 414 | 274 |
| 199 | Example | 0.800 | 0.060 | 0.090 | 0.050 | 0.000 | 0.000 | 0.000 | 1000 | Nanocrystal | 133 | 172 | 1.6 | 139 | 390 | 251 |
| 200 | Reference Example | 0.800 | 0.060 | 0.090 | 0.050 | 0.000 | 0.000 | 0.000 | 1500 | Nanocrystal | 139 | 177 | 2.4 | 129 | 343 | 214 |

TABLE 3

| Samples | Classification | Composition — | $CaCO_3$ mg/l | $MgCO_3$ mg/l | Crystal structure — | Hc A/m | σs A · $m^2$/kg | [Ca] Atom % | [Mg] Atom % | V1 V/mm | V2 V/mm | ΔV V/mm |
|---|---|---|---|---|---|---|---|---|---|---|---|---|
| 45 | Comparative Example | $Fe_{0.800}Nb_{0.06}B_{0.09}P_{0.05}$ | 20 | 4 | Amorphous | 177 | 171 | 0.0 | 0.0 | 118 | 345 | 227 |
| 47 | Example | $Fe_{0.800}Nb_{0.06}B_{0.09}P_{0.05}$ | 1000 | 200 | Amorphous | 168 | 174 | 1.3 | 0.3 | 142 | 497 | 355 |
| 48 | Example | $Fe_{0.800}Nb_{0.06}B_{0.09}P_{0.05}$ | 2000 | 400 | Amorphous | 175 | 178 | 5.2 | 0.6 | 156 | 532 | 376 |
| 49 | Comparative Example | $Fe_{0.800}Nb_{0.06}B_{0.09}P_{0.05}$ | 20 | 4 | Nanocrystal | 140 | 179 | 0.0 | 0.0 | 116 | 342 | 226 |
| 51 | Example | $Fe_{0.800}Nb_{0.06}B_{0.09}P_{0.05}$ | 1000 | 200 | Nanocrystal | 136 | 177 | 1.0 | 0.3 | 139 | 495 | 356 |
| 52 | Example | $Fe_{0.800}Nb_{0.06}B_{0.09}P_{0.05}$ | 2000 | 400 | Nanocrystal | 138 | 179 | 5.0 | 0.7 | 151 | 526 | 375 |
| 53 | Comparative Example | $Fe_{0.905}Si_{0.045}Cr_{0.050}$ | 20 | 4 | Crystal | 794 | 179 | 0.0 | 0.0 | 115 | 341 | 226 |

TABLE 3-continued

| Samples | Classification | Composition — | $CaCO_3$ mg/l | $MgCO_3$ mg/l | Crystal structure — | Hc A/m | σs A · $m^2$/kg | [Ca] Atom % | [Mg] Atom % | V1 V/mm | V2 V/mm | ΔV V/mm |
|---|---|---|---|---|---|---|---|---|---|---|---|---|
| 55 | Example | $Fe_{0.905}Si_{0.045}Cr_{0.050}$ | 1000 | 200 | Crystal | 791 | 177 | 1.2 | 0.2 | 138 | 488 | 350 |
| 56 | Example | $Fe_{0.905}Si_{0.045}Cr_{0.050}$ | 2000 | 400 | Crystal | 802 | 174 | 5.1 | 0.7 | 149 | 521 | 372 |

TABLE 4

| Samples | Fe 1-h | M(Nb) a | B b | P c | Si d | C e | S f | $CaCO_3$ mg/l | $MgCO_3$ mg/l | Hc A/m | σs A · $m^2$/kg | [Ca] Atom % | [Mg] Atom % | V2 V/mm |
|---|---|---|---|---|---|---|---|---|---|---|---|---|---|---|
| 57 | 0.7950 | 0.060 | 0.090 | 0.050 | 0.000 | 0.000 | 0.005 | 2000 | 400 | 140 | 176 | 4.4 | 0.4 | 526 |
| 58 | 0.8350 | 0.020 | 0.090 | 0.050 | 0.000 | 0.000 | 0.005 | 2000 | 400 | 210 | 174 | 1.9 | 0.2 | 439 |
| 59 | 0.8150 | 0.040 | 0.090 | 0.050 | 0.000 | 0.000 | 0.005 | 2000 | 400 | 166 | 175 | 2.7 | 0.4 | 466 |
| 60 | 0.8050 | 0.050 | 0.090 | 0.050 | 0.000 | 0.000 | 0.005 | 2000 | 400 | 140 | 178 | 5.2 | 0.5 | 520 |
| 57 | 0.7950 | 0.060 | 0.090 | 0.050 | 0.000 | 0.000 | 0.005 | 2000 | 400 | 140 | 176 | 4.4 | 0.4 | 526 |
| 61 | 0.7750 | 0.080 | 0.090 | 0.050 | 0.000 | 0.000 | 0.005 | 2000 | 400 | 142 | 175 | 6.1 | 0.6 | 546 |
| 62 | 0.7550 | 0.100 | 0.090 | 0.050 | 0.000 | 0.000 | 0.005 | 2000 | 400 | 136 | 177 | 5.2 | 0.3 | 549 |
| 63 | 0.7350 | 0.120 | 0.090 | 0.050 | 0.000 | 0.000 | 0.005 | 2000 | 400 | 200 | 156 | 5.0 | 0.7 | 550 |
| 64 | 0.7150 | 0.140 | 0.090 | 0.050 | 0.000 | 0.000 | 0.005 | 2000 | 400 | 203 | 170 | 4.8 | 0.7 | 556 |
| 65 | 0.8600 | 0.060 | 0.025 | 0.050 | 0.000 | 0.000 | 0.005 | 2000 | 400 | 198 | 185 | 2.4 | 0.5 | 420 |
| 66 | 0.8250 | 0.060 | 0.060 | 0.050 | 0.000 | 0.000 | 0.005 | 2000 | 400 | 170 | 178 | 3.3 | 0.2 | 461 |
| 67 | 0.8050 | 0.060 | 0.080 | 0.050 | 0.000 | 0.000 | 0.005 | 2000 | 400 | 135 | 173 | 2.0 | 0.3 | 503 |
| 57 | 0.7950 | 0.060 | 0.090 | 0.050 | 0.000 | 0.000 | 0.005 | 2000 | 400 | 140 | 176 | 4.4 | 0.4 | 526 |
| 68 | 0.7650 | 0.060 | 0.120 | 0.050 | 0.000 | 0.000 | 0.005 | 2000 | 400 | 155.2 | 167 | 2.6 | 0.4 | 537 |
| 69 | 0.7350 | 0.060 | 0.150 | 0.050 | 0.000 | 0.000 | 0.005 | 2000 | 400 | 178.4 | 159 | 1.9 | 0.3 | 539 |
| 70 | 0.6850 | 0.060 | 0.200 | 0.050 | 0.000 | 0.000 | 0.005 | 2000 | 400 | 197.6 | 156 | 1.6 | 0.6 | 548 |
| 71 | 0.8440 | 0.060 | 0.090 | 0.001 | 0.000 | 0.000 | 0.005 | 2000 | 400 | 260.8 | 178 | 1.8 | 0.5 | 425 |
| 72 | 0.8400 | 0.060 | 0.090 | 0.005 | 0.000 | 0.000 | 0.005 | 2000 | 400 | 256 | 181 | 2.1 | 0.3 | 444 |
| 73 | 0.8350 | 0.060 | 0.090 | 0.010 | 0.000 | 0.000 | 0.005 | 2000 | 400 | 250.4 | 181 | 3.7 | 0.4 | 466 |
| 74 | 0.8150 | 0.060 | 0.090 | 0.030 | 0.000 | 0.000 | 0.005 | 2000 | 400 | 233.6 | 174 | 3.9 | 0.5 | 504 |
| 57 | 0.7950 | 0.060 | 0.090 | 0.050 | 0.000 | 0.000 | 0.005 | 2000 | 400 | 140 | 176 | 4.4 | 0.4 | 526 |
| 75 | 0.7650 | 0.060 | 0.090 | 0.080 | 0.000 | 0.000 | 0.005 | 2000 | 400 | 171.2 | 164 | 5.9 | 0.3 | 579 |
| 76 | 0.7450 | 0.060 | 0.090 | 0.100 | 0.000 | 0.000 | 0.005 | 2000 | 400 | 184.8 | 155 | 6.1 | 0.4 | 618 |
| 77 | 0.6950 | 0.060 | 0.090 | 0.150 | 0.000 | 0.000 | 0.005 | 2000 | 400 | 200 | 148 | 6.3 | 0.5 | 673 |

TABLE 5

| Samples | Fe 1-h | M(Nb) a | B b | P c | Si d | C e | S f | $CaCO_3$ mg/l | $MgCO_3$ mg/l | Hc A/m | σs A · $m^2$/kg | [Ca] Atom % | [Mg] Atom % | V2 V/mm |
|---|---|---|---|---|---|---|---|---|---|---|---|---|---|---|
| 57 | 0.7950 | 0.060 | 0.090 | 0.050 | 0.000 | 0.000 | 0.005 | 2000 | 400 | 140 | 176 | 4.4 | 0.4 | 526 |
| 78 | 0.7850 | 0.060 | 0.090 | 0.050 | 0.000 | 0.010 | 0.005 | 2000 | 400 | 116.8 | 165 | 4.6 | 0.2 | 432 |
| 79 | 0.7650 | 0.060 | 0.090 | 0.050 | 0.000 | 0.030 | 0.005 | 2000 | 400 | 136.8 | 167 | 3.7 | 0.2 | 405 |
| 80 | 0.7550 | 0.060 | 0.090 | 0.050 | 0.000 | 0.040 | 0.005 | 2000 | 400 | 177.6 | 164 | 2.3 | 0.5 | 402 |
| 57 | 0.7950 | 0.060 | 0.090 | 0.050 | 0.000 | 0.000 | 0.005 | 2000 | 400 | 140 | 176 | 4.4 | 0.4 | 526 |
| 81 | 0.7850 | 0.060 | 0.090 | 0.050 | 0.010 | 0.000 | 0.005 | 2000 | 400 | 150.4 | 171 | 5.1 | 0.6 | 590 |
| 82 | 0.7750 | 0.060 | 0.090 | 0.050 | 0.020 | 0.000 | 0.005 | 2000 | 400 | 161.6 | 165 | 5.8 | 0.3 | 641 |
| 83 | 0.7650 | 0.060 | 0.090 | 0.050 | 0.030 | 0.000 | 0.005 | 2000 | 400 | 178.4 | 167 | 5.5 | 0.4 | 655 |
| 84 | 0.7350 | 0.060 | 0.090 | 0.050 | 0.060 | 0.000 | 0.005 | 2000 | 400 | 195.2 | 160 | 6.9 | 0.5 | 699 |
| 85 | 0.7980 | 0.060 | 0.090 | 0.050 | 0.000 | 0.000 | 0.002 | 2000 | 400 | 140.8 | 172 | 5.2 | 0.3 | 516 |
| 87 | 0.7900 | 0.060 | 0.090 | 0.050 | 0.000 | 0.000 | 0.010 | 2000 | 400 | 219.2 | 173 | 3.6 | 0.7 | 526 |
| 88 | 0.8100 | 0.030 | 0.090 | 0.000 | 0.070 | 0.000 | 0.000 | 2000 | 400 | 226 | 179 | 3.5 | 0.3 | 443 |
| 89 | 0.7900 | 0.030 | 0.090 | 0.000 | 0.090 | 0.000 | 0.000 | 2000 | 400 | 213 | 173 | 4.2 | 0.3 | 541 |
| 90 | 0.7450 | 0.030 | 0.090 | 0.000 | 0.135 | 0.000 | 0.000 | 2000 | 400 | 179 | 168 | 5.2 | 0.5 | 566 |
| 91 | 0.7250 | 0.030 | 0.090 | 0.000 | 0.155 | 0.000 | 0.000 | 2000 | 400 | 157 | 160 | 2.8 | 0.2 | 415 |
| 92 | 0.7050 | 0.030 | 0.090 | 0.000 | 0.175 | 0.000 | 0.000 | 2000 | 400 | 148 | 158 | 2.5 | 0.6 | 407 |
| 93 | 0.7900 | 0.060 | 0.090 | 0.050 | 0.000 | 0.010 | 0.000 | 2000 | 400 | 216 | 172 | 5.6 | 0.4 | 588 |
| 94 | 0.7700 | 0.060 | 0.090 | 0.050 | 0.000 | 0.030 | 0.000 | 2000 | 400 | 198 | 170 | 3.3 | 0.4 | 421 |
| 95 | 0.7400 | 0.060 | 0.000 | 0.050 | 0.000 | 0.150 | 0.000 | 2000 | 400 | 163 | 165 | 3.7 | 0.5 | 465 |
| 96 | 0.7700 | 0.060 | 0.090 | 0.050 | 0.000 | 0.000 | 0.030 | 2000 | 400 | 202 | 168 | 2.6 | 0.2 | 412 |

TABLE 6

| Samples | Fe 1-h | M(Nb) a | B b | P c | Si d | C e | S f | $CaCO_3$ mg/l | $MgCO_3$ mg/l | Hc A/m | σs A · $m^2$/kg | [Ca] Atom % | [Mg] Atom % | V2 V/mm |
|---|---|---|---|---|---|---|---|---|---|---|---|---|---|---|
| 100 | 0.7250 | 0.080 | 0.120 | 0.070 | 0.000 | 0.000 | 0.005 | 2000 | 400 | 220 | 155 | 4.8 | 0.4 | 499 |
| 57 | 0.7950 | 0.060 | 0.090 | 0.050 | 0.000 | 0.000 | 0.005 | 2000 | 400 | 140 | 176 | 4.4 | 0.4 | 526 |

TABLE 6-continued

| Samples | Fe 1-h | M(Nb) a | B b | P c | Si d | C e | S f | $CaCO_3$ mg/l | $MgCO_3$ mg/l | Hc A/m | σs A · $m^2$/kg | [Ca] Atom % | [Mg] Atom % | V2 V/mm |
|---|---|---|---|---|---|---|---|---|---|---|---|---|---|---|
| 101 | 0.8750 | 0.040 | 0.030 | 0.050 | 0.000 | 0.000 | 0.005 | 2000 | 400 | 195.2 | 185 | 2.5 | 0.5 | 530 |
| 102 | 0.8950 | 0.030 | 0.029 | 0.041 | 0.000 | 0.000 | 0.005 | 2000 | 400 | 167.2 | 187 | 2.3 | 0.3 | 488 |
| 103 | 0.8180 | 0.060 | 0.090 | 0.010 | 0.010 | 0.010 | 0.002 | 2000 | 400 | 187.2 | 176 | 2.2 | 0.6 | 597 |
| 104 | 0.7980 | 0.060 | 0.090 | 0.010 | 0.020 | 0.020 | 0.002 | 2000 | 400 | 205.6 | 173 | 6.3 | 0.4 | 585 |
| 105 | 0.7950 | 0.060 | 0.090 | 0.010 | 0.020 | 0.020 | 0.005 | 2000 | 400 | 188 | 171 | 5.7 | 0.3 | 579 |
| 106 | 0.7950 | 0.060 | 0.090 | 0.030 | 0.010 | 0.010 | 0.005 | 2000 | 400 | 160.8 | 169 | 5.5 | 0.4 | 596 |
| 107 | 0.7750 | 0.060 | 0.090 | 0.030 | 0.020 | 0.020 | 0.005 | 2000 | 400 | 187.2 | 161 | 6.5 | 0.5 | 626 |
| 108 | 0.7780 | 0.060 | 0.090 | 0.030 | 0.020 | 0.020 | 0.002 | 2000 | 400 | 168.8 | 158 | 6.6 | 0.5 | 629 |
| 109 | 0.7750 | 0.060 | 0.090 | 0.050 | 0.010 | 0.010 | 0.005 | 2000 | 400 | 154.4 | 160 | 6.8 | 0.4 | 635 |

TABLE 7

| Samples | M | a | $CaCO_3$ mg/l | $MgCO_3$ mg/l | Hc A/m | σs A · $m^2$/kg | [Ca] Atom % | [Mg] Atom % | V2 V/mm |
|---|---|---|---|---|---|---|---|---|---|
| 59 | Nb | 0.040 | 2000 | 400 | 166 | 175 | 2.7 | 0.4 | 466 |
| 110 | Hf | 0.040 | 2000 | 400 | 160 | 173 | 2.2 | 0.3 | 460 |
| 111 | Zr | 0.040 | 2000 | 400 | 161 | 175 | 3.2 | 0.4 | 435 |
| 112 | Ta | 0.040 | 2000 | 400 | 167 | 178 | 4.7 | 0.2 | 424 |
| 113 | Mo | 0.040 | 2000 | 400 | 169 | 177 | 5.2 | 0.6 | 429 |
| 114 | W | 0.040 | 2000 | 400 | 173 | 170 | 3.6 | 0.4 | 453 |
| 115 | V | 0.040 | 2000 | 400 | 175 | 178 | 6.4 | 0.6 | 462 |
| 115a | Ti | 0.040 | 2000 | 400 | 168 | 176 | 4.2 | 0.5 | 467 |
| 116 | $Nb_{0.5}Hf_{0.5}$ | 0.040 | 2000 | 400 | 185 | 175 | 5.2 | 0.2 | 459 |
| 117 | $Zr_{0.5}Ta_{0.5}$ | 0.040 | 2000 | 400 | 162 | 177 | 1.4 | 0.7 | 440 |
| 118 | $Nb_{0.4}Hf_{0.3}Zr_{0.3}$ | 0.040 | 2000 | 400 | 183 | 174 | 5.1 | 0.4 | 458 |
| 57 | Nb | 0.060 | 2000 | 400 | 140 | 176 | 4.4 | 0.4 | 526 |
| 119 | Hf | 0.060 | 2000 | 400 | 135 | 171 | 3.6 | 0.3 | 492 |
| 120 | Zr | 0.060 | 2000 | 400 | 142 | 174 | 2.5 | 0.2 | 495 |
| 121 | Ta | 0.060 | 2000 | 400 | 132 | 166 | 4.5 | 0.3 | 484 |
| 122 | Mo | 0.060 | 2000 | 400 | 147 | 166 | 2.6 | 0.5 | 506 |
| 123 | W | 0.060 | 2000 | 400 | 140 | 170 | 1.9 | 0.3 | 478 |
| 124 | V | 0.060 | 2000 | 400 | 150 | 168 | 1.6 | 0.5 | 499 |
| 124a | Ti | 0.060 | 2000 | 400 | 143 | 169 | 2.7 | 0.5 | 502 |
| 125 | $Nb_{0.5}Hf_{0.5}$ | 0.060 | 2000 | 400 | 135 | 170 | 1.7 | 0.6 | 501 |
| 126 | $Zr_{0.5}Ta_{0.5}$ | 0.060 | 2000 | 400 | 140 | 164 | 2.2 | 0.2 | 498 |
| 127 | $Nb_{0.4}Hf_{0.3}Zr_{0.3}$ | 0.060 | 2000 | 400 | 152 | 168 | 3.6 | 0.4 | 503 |
| 63 | Nb | 0.120 | 2000 | 400 | 200 | 156 | 5.0 | 0.7 | 550 |
| 128 | Hf | 0.120 | 2000 | 400 | 213 | 155 | 4.3 | 0.4 | 521 |
| 129 | Zr | 0.120 | 2000 | 400 | 200 | 157 | 5.9 | 0.2 | 551 |
| 130 | Ta | 0.120 | 2000 | 400 | 217 | 155 | 1.8 | 0.6 | 520 |
| 131 | Mo | 0.120 | 2000 | 400 | 208 | 158 | 6.3 | 0.3 | 515 |
| 132 | W | 0.120 | 2000 | 400 | 218 | 153 | 5.0 | 0.4 | 513 |
| 133 | V | 0.120 | 2000 | 400 | 223 | 154 | 3.5 | 0.3 | 494 |
| 133a | Ti | 0.120 | 2000 | 400 | 220 | 156 | 2.9 | 0.4 | 511 |
| 134 | $Nb_{0.5}Hf_{0.5}$ | 0.120 | 2000 | 400 | 213 | 155 | 3.7 | 0.2 | 518 |
| 135 | $Zr_{0.5}Ta_{0.5}$ | 0.120 | 2000 | 400 | 210 | 157 | 2.3 | 0.3 | 502 |
| 136 | $Nb_{0.4}Hf_{0.3}Zr_{0.3}$ | 0.120 | 2000 | 400 | 230 | 154 | 4.3 | 0.4 | 506 |

TABLE 8

| Samples | X1 | α(1-h) | X2 | β(1-h) | $CaCO_3$ mg/l | $MgCO_3$ mg/l | Hc A/m | σs A · $m^2$/kg | [Ca] Atom % | [Mg] Atom % | V2 V/mm |
|---|---|---|---|---|---|---|---|---|---|---|---|
| 57 | — | 0.000 | — | 0.000 | 2000 | 400 | 140 | 176 | 4.4 | 0.4 | 526 |
| 137 | Co | 0.010 | — | 0.000 | 2000 | 400 | 167.2 | 173 | 2.2 | 0.3 | 521 |
| 138 | Co | 0.100 | — | 0.000 | 2000 | 400 | 191.2 | 173 | 3.1 | 0.2 | 515 |
| 139 | Co | 0.400 | — | 0.000 | 2000 | 400 | 230.4 | 175 | 4.5 | 0.3 | 531 |
| 140 | Ni | 0.010 | — | 0.000 | 2000 | 400 | 140 | 178 | 5.4 | 0.7 | 512 |
| 141 | Ni | 0.100 | — | 0.000 | 2000 | 400 | 133.6 | 166 | 3.4 | 0.4 | 508 |
| 142 | Ni | 0.400 | — | 0.000 | 2000 | 400 | 131.2 | 168 | 6.2 | 0.6 | 499 |
| 143 | — | 0.000 | Al | 0.001 | 2000 | 400 | 122.4 | 166 | 1.4 | 0.2 | 488 |
| 144 | — | 0.000 | Al | 0.005 | 2000 | 400 | 140.8 | 172 | 1.4 | 0.7 | 516 |
| 145 | — | 0.000 | Al | 0.010 | 2000 | 400 | 135.2 | 164 | 3.7 | 0.4 | 563 |
| 146 | — | 0.000 | Al | 0.030 | 2000 | 400 | 143.2 | 163 | 3.7 | 0.5 | 589 |
| 147 | — | 0.000 | Zn | 0.001 | 2000 | 400 | 150.4 | 170 | 3.6 | 0.3 | 604 |
| 148 | — | 0.000 | Zn | 0.005 | 2000 | 400 | 151.2 | 169 | 5.2 | 0.3 | 512 |
| 149 | — | 0.000 | Zn | 0.010 | 2000 | 400 | 139.2 | 166 | 4.5 | 0.4 | 523 |
| 150 | — | 0.000 | Zn | 0.030 | 2000 | 400 | 146.4 | 164 | 2.6 | 0.3 | 604 |
| 151 | — | 0.000 | Sn | 0.001 | 2000 | 400 | 148.8 | 169 | 1.8 | 0.3 | 529 |
| 152 | — | 0.000 | Sn | 0.005 | 2000 | 400 | 149.6 | 172 | 1.6 | 0.5 | 580 |

TABLE 8-continued

| Samples | X1 | α(1-h) | X2 | β(1-h) | $CaCO_3$ mg/l | $MgCO_3$ mg/l | Hc A/m | σs A · $m^2$/kg | [Ca] Atom % | [Mg] Atom % | V2 V/mm |
|---|---|---|---|---|---|---|---|---|---|---|---|
| 153 | — | 0.000 | Sn | 0.010 | 2000 | 400 | 140 | 167 | 1.7 | 0.3 | 598 |
| 154 | — | 0.000 | Sn | 0.030 | 2000 | 400 | 156 | 165 | 2.2 | 0.3 | 604 |
| 155 | — | 0.000 | Cu | 0.001 | 2000 | 400 | 128 | 165 | 3.6 | 0.4 | 566 |
| 156 | — | 0.000 | Cu | 0.005 | 2000 | 400 | 126.4 | 166 | 5.0 | 0.7 | 593 |
| 157 | — | 0.000 | Cu | 0.010 | 2000 | 400 | 130.4 | 170 | 4.3 | 0.8 | 602 |
| 158 | — | 0.000 | Cu | 0.030 | 2000 | 400 | 127.2 | 175 | 5.5 | 0.3 | 632 |
| 159 | — | 0.000 | Cr | 0.001 | 2000 | 400 | 151.2 | 170 | 1.8 | 0.6 | 575 |
| 160 | — | 0.000 | Cr | 0.005 | 2000 | 400 | 138.4 | 172 | 6.3 | 0.5 | 611 |
| 161 | — | 0.000 | Cr | 0.010 | 2000 | 400 | 135.2 | 167 | 5.0 | 0.4 | 600 |
| 162 | — | 0.000 | Cr | 0.030 | 2000 | 400 | 147.2 | 163 | 2.1 | 0.4 | 613 |

TABLE 9

| Samples | X1 | α(1-h) | X2 | β(1-h) | $CaCO_3$ mg/l | $MgCO_3$ mg/l | H A/m | σs A · $m^2$/kg | [Ca] Atom % | [Mg] Atom % | V2 V/mm |
|---|---|---|---|---|---|---|---|---|---|---|---|
| 163 | — | 0.000 | Bi | 0.001 | 2000 | 400 | 142.4 | 167 | 3.7 | 0.3 | 562 |
| 164 | — | 0.000 | Bi | 0.005 | 2000 | 400 | 132.8 | 169 | 2.3 | 0.3 | 583 |
| 165 | — | 0.000 | Bi | 0.010 | 2000 | 400 | 155.2 | 167 | 4.3 | 0.4 | 601 |
| 166 | — | 0.000 | Bi | 0.030 | 2000 | 400 | 149.6 | 165 | 4.7 | 0.4 | 614 |
| 167 | — | 0.000 | La | 0.001 | 2000 | 400 | 149.6 | 162 | 2.2 | 0.5 | 522 |
| 168 | — | 0.000 | La | 0.005 | 2000 | 400 | 153.6 | 167 | 1.6 | 0.4 | 575 |
| 169 | — | 0.000 | La | 0.010 | 2000 | 400 | 163.2 | 174 | 4.7 | 0.3 | 589 |
| 170 | — | 0.000 | La | 0.030 | 2000 | 400 | 170.4 | 166 | 5.2 | 0.6 | 606 |
| 171 | — | 0.000 | Y | 0.001 | 2000 | 400 | 158.4 | 170 | 3.6 | 0.2 | 561 |
| 172 | — | 0.000 | Y | 0.005 | 2000 | 400 | 149.6 | 169 | 5.7 | 0.7 | 576 |
| 173 | — | 0.000 | Y | 0.010 | 2000 | 400 | 148 | 164 | 5.2 | 0.3 | 599 |
| 174 | — | 0.000 | Y | 0.030 | 2000 | 400 | 147.2 | 163 | 1.4 | 0.7 | 607 |
| 175 | Co | 0.000 | Al | 0.050 | 2000 | 400 | 164 | 172 | 4.2 | 0.3 | 565 |
| 176 | Co | 0.000 | Zn | 0.050 | 2000 | 400 | 175.2 | 169 | 4.4 | 0.4 | 576 |
| 177 | Co | 0.000 | Sn | 0.050 | 2000 | 400 | 183.2 | 171 | 3.6 | 0.3 | 569 |
| 178 | Co | 0.100 | Cu | 0.050 | 2000 | 400 | 152.8 | 166 | 2.2 | 0.3 | 585 |
| 179 | Co | 0.100 | Cr | 0.050 | 2000 | 400 | 164 | 173 | 4.5 | 0.4 | 570 |
| 180 | Co | 0.100 | Bi | 0.050 | 2000 | 400 | 173.6 | 165 | 2.6 | 0.3 | 563 |
| 181 | Co | 0.100 | La | 0.050 | 2000 | 400 | 176.8 | 169 | 1.9 | 0.3 | 578 |
| 182 | Co | 0.100 | Y | 0.050 | 2000 | 400 | 184 | 172 | 1.6 | 0.5 | 567 |
| 183 | Ni | 0.100 | Al | 0.050 | 2000 | 400 | 132.8 | 165 | 1.7 | 0.6 | 579 |
| 184 | Ni | 0.100 | Zn | 0.050 | 2000 | 400 | 131.2 | 163 | 2.2 | 0.3 | 584 |
| 185 | Ni | 0.100 | Sn | 0.050 | 2000 | 400 | 131.2 | 170 | 3.6 | 0.4 | 567 |
| 186 | Ni | 0.100 | Cu | 0.050 | 2000 | 400 | 137.6 | 168 | 5.0 | 0.7 | 581 |
| 187 | Ni | 0.100 | Cr | 0.050 | 2000 | 400 | 134.4 | 167 | 4.3 | 0.4 | 562 |
| 188 | Ni | 0.100 | Bi | 0.050 | 2000 | 400 | 135.2 | 164 | 5.7 | 0.2 | 578 |
| 189 | Ni | 0.100 | La | 0.050 | 2000 | 400 | 120.8 | 160 | 1.8 | 0.6 | 567 |
| 190 | Ni | 0.100 | Y | 0.050 | 2000 | 400 | 148 | 164 | 3.4 | 0.3 | 576 |

TABLE 10

| Samples | Fe 1-h | M(Nb) a | B b | P c | Si d | C e | S f | $CaCO_3$ mg/l | $MgCO_3$ mg/l | Kind of powder glass | Hc A/m | σs A · $m^2$/kg | [Ca] Atom % | [Mg] Atom % | V2 V/mm |
|---|---|---|---|---|---|---|---|---|---|---|---|---|---|---|---|
| 191 | 0.7950 | 0.060 | 0.090 | 0.050 | 0.000 | 0.000 | 0.005 | 2000 | 400 | $Bi_2O_3$-based | 142 | 178 | 3.9 | 0.3 | 524 |
| 192 | 0.7950 | 0.060 | 0.090 | 0.050 | 0.000 | 0.000 | 0.005 | 2000 | 400 | $B_2O_3$—$SiO_2$-based | 139 | 175 | 4.7 | 0.5 | 530 |

TABLE 11

| Samples | Classification | Fe 1-h | M(Nb) a | B b | P c | Si d | C e | S f | $CaCO_3$ mg/l | Crystal structure — | Hc A/m | σs A · $m^2$/ kg | [Ca] Atom % | V1 V/ mm | V2 V/ mm | ΔV V/ mm |
|---|---|---|---|---|---|---|---|---|---|---|---|---|---|---|---|---|
| 201 | Comparative Example | 0.7690 | 0.060 | 0.090 | 0.050 | 0.030 | 0.000 | 0.001 | 20 | Amorphous | 169 | 173 | 0.0 | 122 | 347 | 225 |
| 202 | Example | 0.7690 | 0.060 | 0.090 | 0.050 | 0.030 | 0.000 | 0.001 | 1000 | Amorphous | 172 | 170 | 1.4 | 133 | 484 | 351 |
| 203 | Example | 0.7690 | 0.060 | 0.090 | 0.050 | 0.030 | 0.000 | 0.001 | 2000 | Amorphous | 170 | 171 | 3.8 | 153 | 519 | 366 |
| 204 | Comparative Example | 0.7690 | 0.060 | 0.090 | 0.050 | 0.030 | 0.000 | 0.001 | 20 | Nanocrystal | 136 | 179 | 0.0 | 117 | 345 | 228 |
| 205 | Example | 0.7690 | 0.060 | 0.090 | 0.050 | 0.030 | 0.000 | 0.001 | 1000 | Nanocrystal | 137 | 175 | 1.2 | 129 | 486 | 357 |
| 206 | Example | 0.7690 | 0.060 | 0.090 | 0.050 | 0.030 | 0.000 | 0.001 | 2000 | Nanocrystal | 135 | 178 | 3.9 | 147 | 516 | 369 |

INDUSTRIAL APPLICABILITY

For example, the soft magnetic metal powder according to the invention is suitable for a material of a magnetic core of an inductor.

REFERENCE SIGNS LIST

1: soft magnetic metal particle, 2: metal particle, 3: oxidized part, 4: coating part.

What is claimed is:

1. A soft magnetic metal powder including a plurality of soft magnetic metal particles, wherein each of the soft magnetic metal particles includes a metal particle and an oxidized part covering the metal particle, the metal particle includes at least Fe, the oxidized part includes an oxide of at least one kind of element selected from the group consisting of Fe, Si, and B, and at least one kind of element of Ca and Mg, the metal particle includes an alloy expressed by the following Chemical Formula 1, $$(Fe_{(1-(\alpha+\beta))}X1_{\alpha}X2_{\beta})_{(1-h)}M_aB_bP_cSi_dC_eS_f \quad (1),$$

M in the Chemical Formula 1 is at least one kind of element selected from the group consisting of Nb, Hf, Zr, Ta, Mo, W, Ti, and V, X1 in the Chemical Formula 1 is at least one kind of element selected from the group consisting of Co and Ni, X2 in the Chemical Formula 1 is at least one kind of element selected from the group consisting of Al, Mn, Ag, Zn, Sn, As, Sb, Cu, Cr, Bi, N, O, and a rare earth element, the rare earth element is at least one kind of element selected from the group consisting of Sc, Y, La, Ce, Pr, Nd, Pm, Sm, Eu, Gd, Tb, Dy, Ho, Er, Tm, Yb, and Lu, h in the Chemical Formula 1 is equal to a+b+c+d+e+f, h in the Chemical Formula 1 is more than 0 and less than 1, a in the Chemical Formula 1 satisfies $0.020 \le a \le 0.140$, b in the Chemical Formula 1 satisfies $0 \le b \le 0.20$, c in the Chemical Formula 1 satisfies $0 \le c \le 0.15$, d in the Chemical Formula 1 satisfies $0 \le d \le 0.175$, e in the Chemical Formula 1 satisfies $0 \le e \le 0.150$, f in the Chemical Formula 1 satisfies $0 \le f \le 0.030$, $\alpha+\beta$ in the Chemical Formula 1 satisfies $0 \le \alpha+\beta \le 0.50$, a concentration of Ca or Mg in the metal particle and the oxidized part is maximum in the oxidized part, and an average value of a maximum value of the concentration of Ca in the oxidized part is 0.2 atom % or more and 10.0 atom % or less, or an average value of a maximum value of the concentration of Mg in the oxidized part is 0.2 atom % or more and 2.0 atom % or less.

2. The soft magnetic metal powder according to claim 1, wherein 1-h in the Chemical Formula 1 satisfies $0.6844 \le 1-h \le 0.9050$, or $0.73 \le 1-h \le 0.95$, $\alpha$ and h in the Chemical Formula 1 satisfy $0 \le \alpha(1-h) \le 0.40$, and $\beta$ and h in the Chemical Formula 1 satisfy $0 \le \beta(1-h) \le 0.050$.

3. The soft magnetic metal powder according to claim 1, wherein the concentration of Ca or Mg in the oxidized part is maximum in an outermost surface region of the oxidized part.

4. The soft magnetic metal powder according to claim 3, wherein the outermost surface region of the oxidized part is a region within a distance of 2 nm from the outermost surface of the oxidized part in the oxidized part.

5. The soft magnetic metal powder according to claim 1, wherein at least a part of the metal particle is an amorphous phase.

6. The soft magnetic metal powder according to claim 1, wherein at least a part of the metal particle is a nanocrystal phase.

7. The soft magnetic metal powder according to claim 1, wherein the soft magnetic metal particle further includes a coating part covering the oxidized part.

8. The soft magnetic metal powder according to claim 7, wherein at least one kind of element of Ca and Mg exists in an interface between the oxidized part and the coating part.

9. The soft magnetic metal powder according to claim 7, wherein the coating part includes glass.

10. An electronic component containing:

the soft magnetic metal powder according to claim 1.

* * * * *